US009247353B2

(12) United States Patent
Bewley

(10) Patent No.: US 9,247,353 B2
(45) Date of Patent: Jan. 26, 2016

(54) ACOUSTIC COUPLER

(75) Inventor: Michael Bewley, Neutral Bay (AU)

(73) Assignee: Cochlear Limited, Macquarie University, NSW (AU)

( * ) Notice: Subject to any disclaimer, the term of this patent is extended or adjusted under 35 U.S.C. 154(b) by 719 days.

(21) Appl. No.: 13/434,499

(22) Filed: Mar. 29, 2012

(65) Prior Publication Data

US 2013/0216078 A1 Aug. 22, 2013

Related U.S. Application Data

(60) Provisional application No. 61/601,336, filed on Feb. 21, 2012.

(51) Int. Cl.
*H04R 25/00* (2006.01)

(52) U.S. Cl.
CPC ..... *H04R 25/556* (2013.01); *H04R 25/65* (2013.01); *H04R 25/606* (2013.01); *H04R 2225/021* (2013.01); *Y10T 29/49117* (2015.01)

(58) Field of Classification Search
CPC .... H04R 25/60; H04R 25/604; H04R 25/608; H04R 25/556; H04R 2225/021; H04R 25/65; H04R 5/04; H04R 2225/63; H04R 2460/00; H04R 1/10; H04R 5/033; H04R 25/00; H04R 2201/109; H04R 1/105; H04R 2201/03
See application file for complete search history.

(56) References Cited

U.S. PATENT DOCUMENTS

| | | | | |
|---|---|---|---|---|
| 3,542,973 | A * | 11/1970 | Bosch et al. | 381/324 |
| 4,683,587 | A * | 7/1987 | Silverman | 381/311 |
| 7,729,774 | B1 * | 6/2010 | Lynch et al. | 607/57 |
| 2003/0156710 | A1 * | 8/2003 | Kear | 379/388.01 |
| 2004/0044389 | A1 * | 3/2004 | Crawford | 607/116 |
| 2004/0196996 | A1 * | 10/2004 | Feitel | 381/322 |
| 2005/0259829 | A1 | 11/2005 | Van den Heuvel et al. | |
| 2008/0310666 | A1 * | 12/2008 | Wengreen | 381/381 |
| 2009/0245525 | A1 * | 10/2009 | Zhang et al. | 381/60 |
| 2009/0285436 | A1 * | 11/2009 | Lowry | 381/380 |
| 2010/0137107 | A1 * | 6/2010 | Jamsa et al. | 482/8 |
| 2011/0170731 | A1 * | 7/2011 | Beckhart | 381/381 |
| 2013/0089229 | A1 * | 4/2013 | Kristo et al. | 381/326 |

FOREIGN PATENT DOCUMENTS

| | | |
|---|---|---|
| KR | 20-0255386 | 11/2001 |
| KR | 10-2006-0007196 | 1/2006 |
| KR | 10-2011-0065518 | 6/2011 |
| WO | 99/13682 | 3/1999 |

OTHER PUBLICATIONS

International Search Report and Written Opinion for International Application No. PCT/IB2013/051433 mailed Aug. 27, 2013 (11 pages).

* cited by examiner

*Primary Examiner* — Duc Nguyen
*Assistant Examiner* — Taunya McCarty
(74) *Attorney, Agent, or Firm* — Hauptman Ham, LLP

(57) ABSTRACT

An acoustic coupler for a hearing device. The hearing device including a microphone. The acoustic coupler includes an earphone receptacle formed to releasably engage an earphone therein and a securing feature formed to detachably engage the coupler to the hearing device in proximity to the microphone.

49 Claims, 17 Drawing Sheets

700
720
734
732
780
492
490
180

ACOUSTIC COUPLER

CROSS-REFERENCE TO RELATED APPLICATIONS

This application claims priority to U.S. Provisional Application No. 61/601,336 filed on Feb. 21, 2012. This application is hereby incorporated by reference herein in its entirety.

BACKGROUND

1. Field of the Invention

The present invention relates generally to hearing prostheses, and more particularly, to an acoustic coupler that interfaces with an external component of a hearing prosthesis.

2. Related Art

Hearing loss, which may be due to many different causes, is generally of two types, conductive and sensorineural. Conductive hearing loss occurs when the normal mechanical pathways for sound to reach the cochlea are impeded, for example, by damage to the ossicles. Individuals suffering from conductive hearing loss typically have some form of residual hearing because the cochlea is undamaged. As a result, individuals suffering from conductive hearing loss typically receive an acoustic hearing aid that amplifies received sound to compensate for the conductive hearing loss.

Sensorineural hearing loss occurs when there is damage to the inner ear or the neural pathways from the inner ear to the brain. As such, those suffering from sensorineural hearing loss are typically unable to derive suitable benefit from hearing prostheses that cause mechanical vibrations of the cochlea. In contrast, cochlear implants deliver electrical stimulation to the neural pathways in the cochlea.

Users of hearing prostheses often seek to listen to music from portable devices. Typically, electrical signal communication is established between a sound processor of the hearing prostheses and the portable device to feed the music electronically to the hearing prosthesis. That is, output from the portable device typically bypasses any microphone of the hearing prostheses.

SUMMARY

According to an exemplary embodiment, there is an acoustic coupler, comprising a coupling body configured to establish an acoustic path between an earphone ear interface and a microphone of an external component of a hearing prosthesis while the external component is worn by a recipient.

According to another exemplary embodiment, there is an acoustic coupler, comprising a coupling body having a cavity extending from a first opening in the coupling body to the second opening in the coupling body, wherein the acoustic coupler is configured to interface with an earphone ear interface at least one of proximate the cavity or in the cavity and interface with an external component of a hearing prosthesis at least one of proximate the cavity or in the cavity, while the external component is worn by a recipient, such that an acoustic path is established by the cavity between the earphone ear interface and a microphone of the external component.

According to another exemplary embodiment, there is an acoustic coupler for a hearing device, the hearing device comprising a microphone, the acoustic coupler comprising an earphone receptacle formed to releasably engage an earphone therein, and a securing feature configured to detachably engage the coupler to the hearing device in proximity to the microphone.

According to another exemplary embodiment, there is a method of coupling an earphone to a hearing device, the method comprising engaging an earphone in an earphone receptacle of an acoustic coupler, the acoustic coupler comprising, an earphone receptacle formed to releasably engage an earphone therein, and a securing feature formed to detachably engage the coupler to the hearing device in proximity to the microphone, and engaging the securing feature of the acoustic coupler with the hearing device.

DESCRIPTION OF THE DRAWINGS

Aspects and embodiments of the present invention are described herein with reference to the attached drawings in which.

DETAILED DESCRIPTION

Figure 1A:
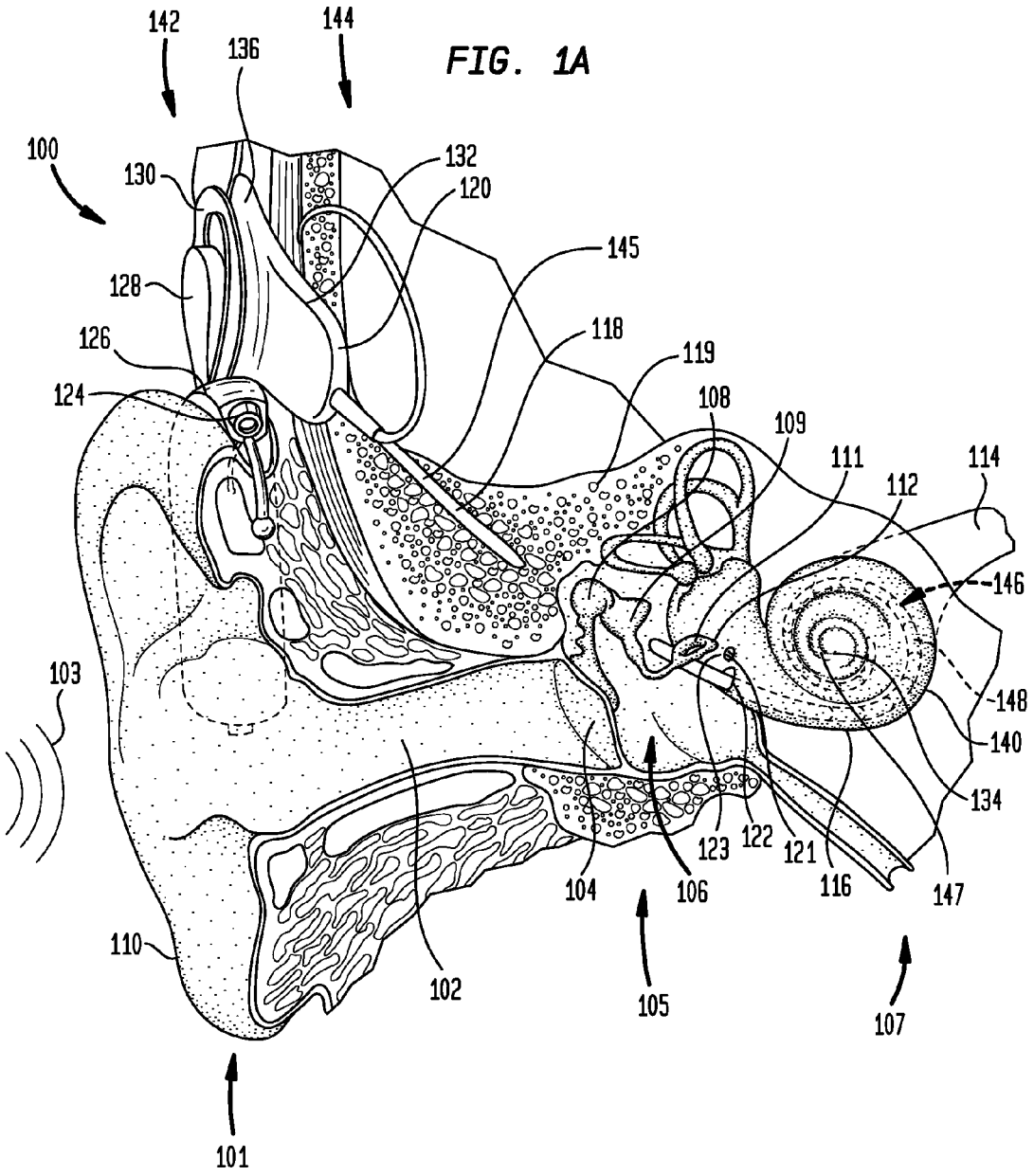
FIG. 1A is a perspective view of an exemplary stimulating medical device, a cochlear implant, having an implantable component and an external component in the form of a behind-the-ear (BTE) device in accordance with an embodiment of the present invention.

Aspects of the present invention are generally directed toward an acoustic coupler for connecting a standard earphone to a component of a hearing prosthesis that has an integrated microphone. The acoustic coupler has an interior cavity that provides a pathway for sound to travel from an attached earphone to the microphone on the attached hearing prosthesis component. Specifically, the acoustic coupler has an earphone receptacle configured to detachably connect an earphone with its earpiece diaphragm facing into the coupler's interior volume. Similarly, the acoustic coupler is releasably secured to the prosthesis component such that the component microphone diaphragm faces into the coupler's interior channel.

Embodiments of the present technology are described herein primarily in connection with a BTE device of a cochlear implant. Embodiments detailed herein and/or variations thereof may be also utilized with other hearing technologies, such, as, for example, bone conduction devices, acoustic hearing aids, middle ear implants, and other hearing technologies currently known and/or to be later developed, including those that use a transducer such as a microphone or other device for receiving acoustic signals.

FIG. 1 is a perspective view of an exemplary cochlear implant 100 implanted in a recipient having an outer ear 101, a middle ear 105, and an inner ear 107. Components of outer ear 101, middle ear 105, and inner ear 107 are described below, followed by a description of cochlear implant 100.

In a fully functional ear, outer ear 101 comprises an auricle 110 and an ear canal 102 (referred to herein sometimes as the outer ear canal). An acoustic pressure or sound wave 103 is collected by auricle 110 and channeled into and through ear canal 102. Disposed across the distal end of ear cannel 102 is a tympanic membrane 104 that vibrates in response to sound wave 103. This vibration is coupled to oval window or fenestra ovalis 112 through three bones of middle ear 105, collectively referred to as the ossicles 106 and comprising the malleus 108, the incus 109, and the stapes 111. Bones 108, 109, and 111 of middle ear 105 serve to filter and amplify sound wave 103, causing oval window 112 to articulate, or vibrate, in response to vibration of tympanic membrane 104. This vibration sets up waves of fluid motion of the perilymph within cochlea 140. Such fluid motion, in turn, activates tiny hair cells (not shown) inside of cochlea 140. Activation of the hair cells causes appropriate nerve impulses to be generated and transferred through the spiral ganglion cells (not shown) and auditory nerve 114 to the brain (also not shown) where they are perceived as sound.

Cochlear implant 100 comprises an external component 142 that is directly or indirectly attached to the body of the recipient, and an internal or implantable component 144 that is temporarily or permanently implanted in the recipient.

External component 142 typically comprises one or more sound input elements, such as microphone 124 for detecting sound, a sound processing unit (not shown), a power source (not shown). Collectively, these components may be part of a behind-the-ear (BTE) device 126, as depicted in FIG. 1A. The external component 142 may further include a transmitter unit 128 remote from the BTE device. External transmitter unit 128 comprises an external coil 130, and preferably, a magnet (not shown) secured directly or indirectly to external coil 130. Sound processing unit 126 processes the output of microphone 124 that is positioned, in the depicted embodiment, by auricle 110 of the recipient. Sound processing unit 126 generates encoded signals, sometimes referred to herein as encoded data signals, which are provided to external transmitter unit 128 via a cable (not shown).

Internal component 144 comprises an internal receiver unit 132, a stimulator unit 120, and an elongate stimulating lead assembly 118. Internal receiver unit 132 comprises an internal coil 136, and preferably, a magnet (also not shown) fixed relative to the internal coil. Internal receiver unit 132 and stimulator unit 120 are hermetically sealed within a biocompatible housing, sometimes collectively referred to as a stimulator/receiver unit. Internal coil 136 receives power and stimulation data from external coil 130, as noted above. Elongate stimulating lead assembly 118 has a proximal end connected to stimulator unit 120, and extends through mastoid bone 119. Lead assembly 118 has a distal region, referred to as electrode assembly 145, implanted in cochlea 140. As used herein the term "stimulating lead assembly," refers to any device capable of providing stimulation to a recipient, such as, for example, electrical or optical stimulation.

Electrode assembly 145 may be implanted at least in basal region 116 of cochlea 140, and sometimes further. For example, electrode assembly 145 may extend towards apical end of cochlea 140, referred to as cochlea apex 134. Electrode assembly 145 may be inserted into cochlea 140 via a cochleostomy 122, or through round window 121, oval window 112, and the promontory 123 or opening in an apical turn 147 of cochlea 140.

Electrode assembly 145 has disposed therein or thereon a longitudinally aligned and distally extending array 146 of electrode contacts 148, sometimes referred to as electrode array 146 herein. Throughout this description, the term "electrode array" means a collection of two or more electrode contacts, sometimes referred to simply as contacts herein. As used herein, electrode contacts or other elements disposed in a carrier refer to elements integrated in, or positioned on, the carrier member. As such, electrode array 146 is referred to herein as being disposed in electrode assembly 145. Stimulator unit 120 generates stimulation signals which are applied by electrodes 148 to cochlea 140, thereby stimulating auditory nerve 114.

In cochlear implant 100, external coil 130 transmits electrical signals (i.e., power and stimulation data) to internal coil 136 via a radio frequency (RF) link. Internal coil 136 is typically a wire antenna coil comprised of multiple turns of electrically insulated single-strand or multi-strand platinum or gold wire. The electrical insulation of internal coil 136 is provided by a flexible silicone molding (not shown). In use, implantable receiver unit 132 may be positioned in a recess of the temporal bone adjacent auricle 110 of the recipient.

As noted, FIG. 1A illustrates a context of the present technology in which cochlear implant 100 includes an external component 142.

Figure 1B:
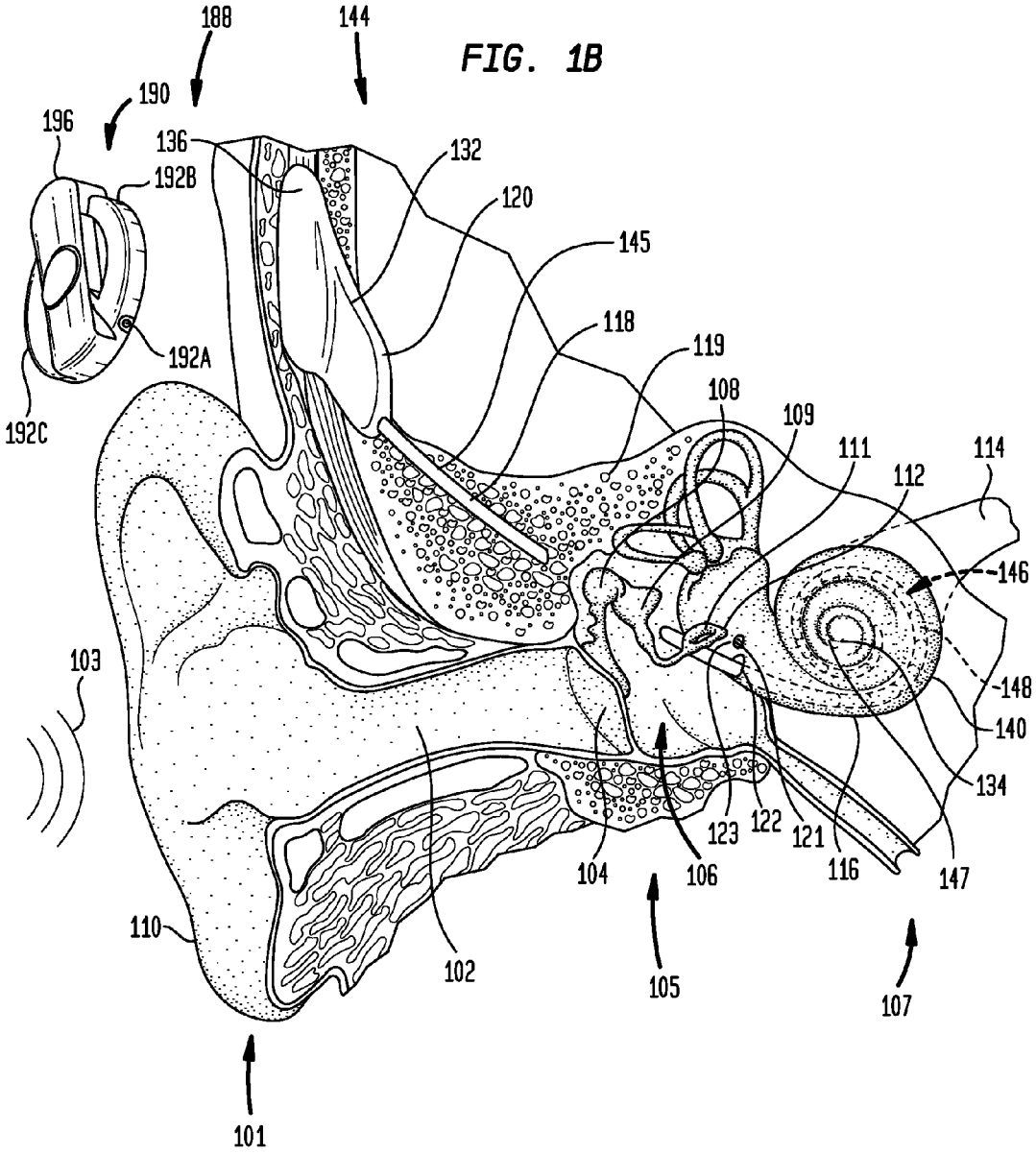
FIG. 1B is a perspective view of an exemplary stimulating medical device, a cochlear implant, having an implantable component and an external component in the form of a button sound processor in accordance with an embodiment of the present invention.

FIG. 1B is a perspective view of an exemplary embodiment of an alternate arrangement of a cochlear implant 188 in accordance with some other embodiments of the present invention. The embodiment of FIG. 1B corresponds to the embodiment of FIG. 1A just detailed, except that the external component 142 of cochlear implant 100 is replaced by external component 190, which is sometimes referred to as a "button sound processor." In an exemplary embodiment, the external component 190 performs some and/or all of the functions of the external component 142 detailed above. As with the transmitter unit 128 of the external component 142, external component 190 may be held against the skin of the recipient via a magnetic field between ferromagnetic materials of the external component and the internal component.

In some embodiments, external component 190 is directly or indirectly attached to the body of the recipient via any device, system or method that can enable such attachment. External component 190 can comprise one or more sound input elements, such as microphones 192A, 192B, and 192C, for detecting sound, a sound processing unit 196, a power source (not shown), and an external transmitter unit (also not shown). The external transmitter unit comprises an external coil (not shown). Sound processing unit 196 processes the output of microphones 192A, 192B and/or 192C and generates encoded signals, sometimes referred to herein as encoded data signals, which are provided to the external transmitter unit. For ease of illustration, the external component 190 is shown detached from the recipient.

Figure 2A:
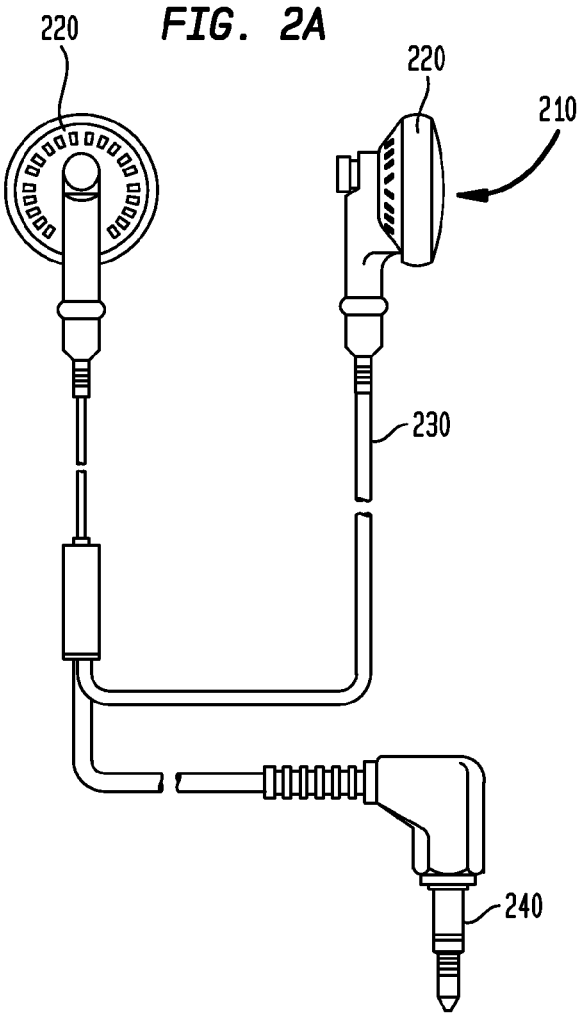
FIGS. 2A-2C depict exemplary earphones usable in some embodiments of the present invention.
Figure 2B:
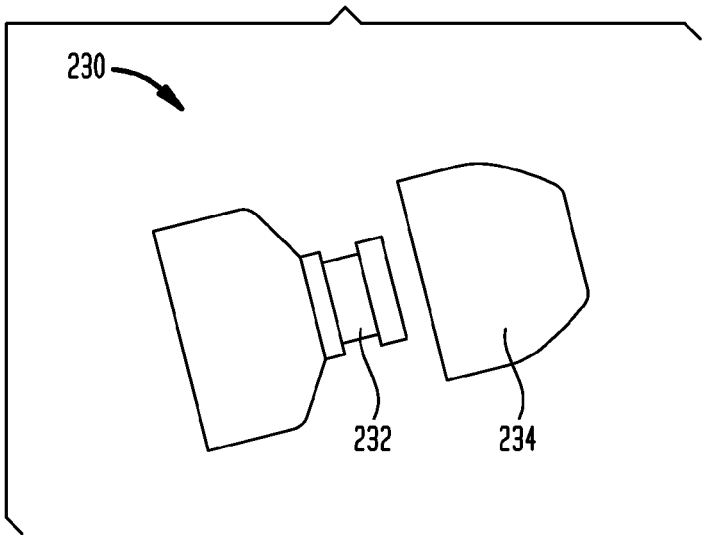
Figure 2C:
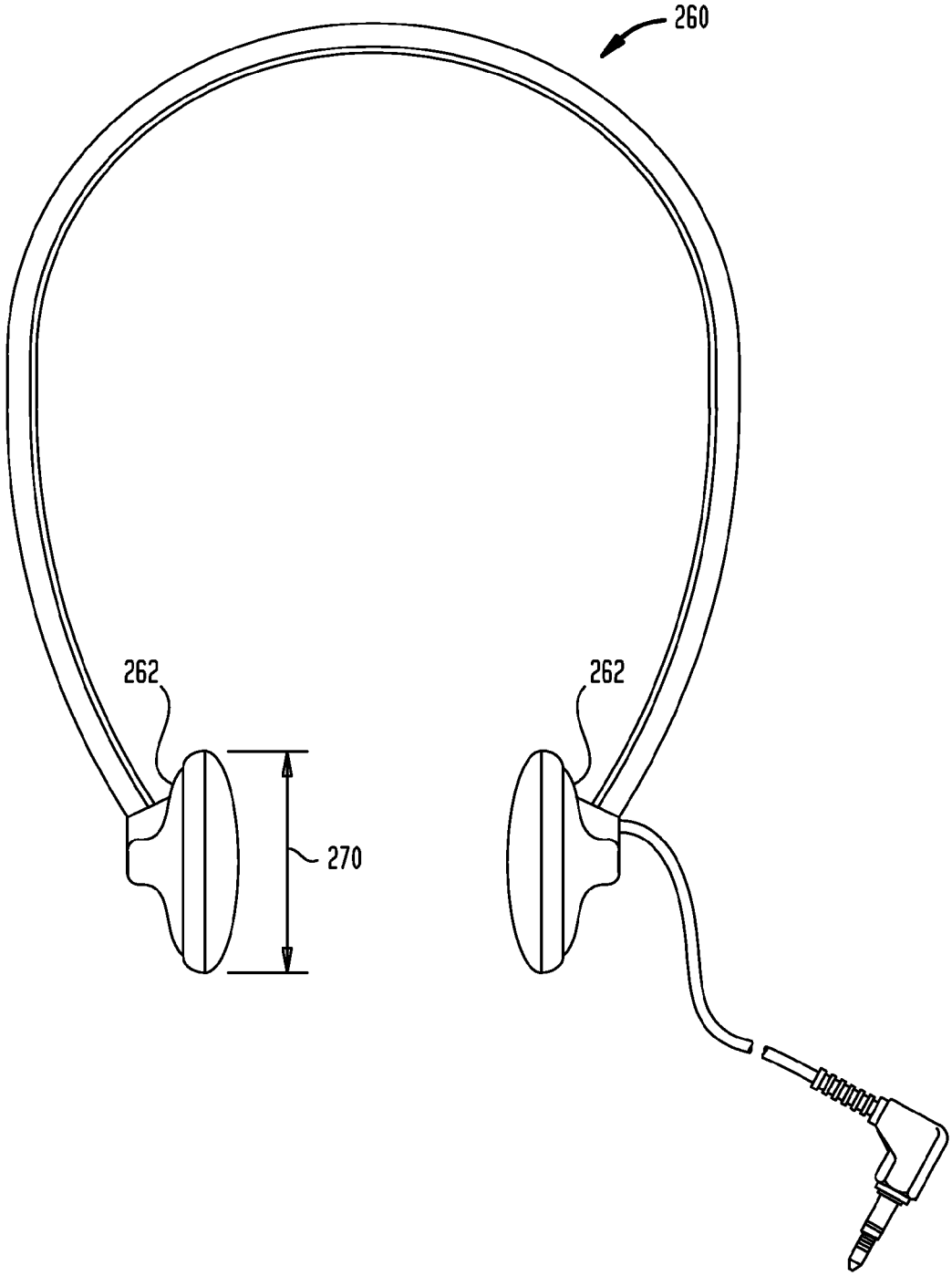

FIG. 2A illustrates a outer earphone 210 (sometimes referred to as a bud earphone), including ear interface components 220 (often referred to as a bud) that fit in the outer ear of a recipient. In the exemplary embodiment of FIG. 2A, the outer earphone 210 is cushionless, but in other embodiments, the outer earphone 210 is cushioned. The ear interface components 220 include transducers in the form of speakers (not shown) that transduce electrical signals received from wires 230, which in-turn receive the electrical signals from input jack 240 which is configured to connect to, for example, a portable electronic device such as a radio, an MP3 player, a tape player, a CD player, etc. FIG. 2B illustrates an exemplary ear interface component 230 of a canal earplug earphone, including a base 232 and eartip 234, where at least the ear tip 234 is configured to be inserted into the outer ear canal 102 of the recipient. It is noted that while the embodiments of the earphone 210 depicted in FIG. 2A and the canalphone 230 of FIG. 2B are configured for insertion into the outer ear and the outer ear canal, respectively, of a recipient, other embodiments of an earphone 210 are configured to instead interface with the auricle 110 of the ear. FIG. 2C depicts an exemplary embodiment of such earphones 260, having speaker assemblies 262 that interface against the auricle 110, where the speaker assemblies 262 have a diameter 270 of about ½ inch to about 2 inches, about ¾ inch to about 2 inches, about 1 inch to about 2 inches, and any value within any of these ranges). Hereinafter, the devices according to FIGS. 2A, 2B and 2C and variations thereof are referred to as "standard equipment earphones," and the portions thereof that interface with the ear (e.g., elements 220, 234, and 260) are referred to as "standard equipment earphone ear interfaces." This as differentiated from, for example, auricle encompassing headphones, which generally are of a size that encompass the entire auricle 110. While most embodiments detailed herein are described in terms of a device that interfaces with a device corresponding to the outer earphone 210 of FIG. 2A, some embodiments interface with devices different from that of FIG. 2A. In this regard, some embodiments detailed herein and/or variations thereof may be used in conjunction with any device that outputs an acoustic signal that is conducted from a source through the air for receipt by an ear of a human to evoke a hearing percept therein through natural hearing. Still further, some embodiments detailed herein and/or variations thereof may be used in conjunction with devices that output other types of signals.

Figure 3A:
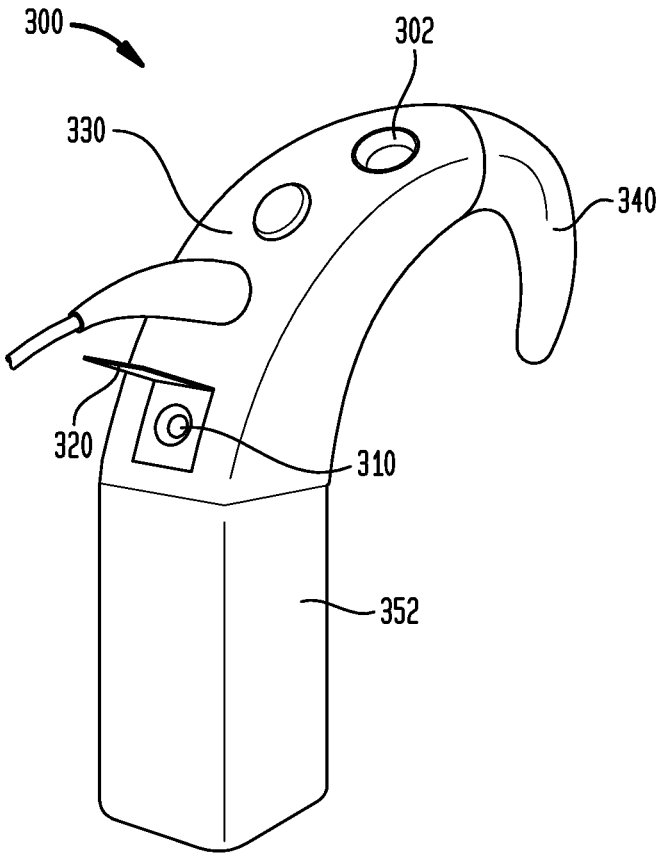
FIG. 3A depicts an exemplary BTE device usable in some embodiments of the present invention.

FIG. 3A is a perspective view of a BTE device 300 of a hearing prosthesis, which, in this exemplary embodiment, corresponds to BTE device 126 detailed above with respect to FIG. 1. BTE device 300 may include one or more microphones 302, and may further include an audio signal jack 310 under a cover 320 on the spine 330 of BTE device 300. It is noted that in some other embodiments, one or both of these components (microphone 302 and/or jack 310) may be located on other positions of the BTE device 300, such as, for example, the side of the spine 330 (as opposed to the back of the spine 330, as depicted in FIG. 3), the ear hook 340, etc. As will now be described, some embodiments include a passive acoustic coupler that can couple standard equipment earphones (both earbuds and canalphones) to a hearing prosthesis without the use of a tool or electrical connection, and/or without having to modify existing BTE devices and earphones and/or without having to open hatches and/or pull portions of the BTE device apart/separate portions of the BTE device or otherwise adjust portions of the BTE device relative to one another and/or having to power the BTE device down and/or off, etc.

Figure 3B:
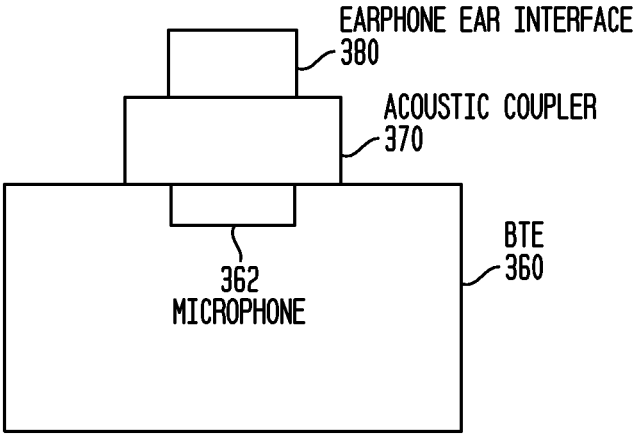
FIG. 3B depicts an exemplary functional schematic of an embodiment of the present invention.

FIG. 3B depicts a functional diagram depicting use of an acoustic coupler 370 according to an exemplary embodiment. As may be seen in FIG. 3B, acoustic coupler 370 forms a mechanical and an acoustical interface between earphone ear interface 380 and BTE device 360. Earphone ear interface 380 may correspond to the earphone ear interface of any of the earphones of FIGS. 2A-2C and/or variations thereof. BTE device 360 may correspond to any BTE device herein and/or variations thereof. Thus, the functional diagram of FIG. 3B corresponds to various embodiments detailed herein. However, it is noted that other embodiments may have variations from the basic functional framework depicted in FIG. 3B.

As may be seen in FIG. 3B, acoustic coupler 370 is configured to be positioned proximate microphone 362 of BTE device and is configured establish an acoustic path between the microphone 362 and the earphone ear interface 380 to enhance transmission of sound waves from the speaker of the earphone ear interface 380 to the microphone 360 relative to that which would be exhibited, for the same output from the speaker of the earphone ear interface 380, if the earphone ear interface 380 was positioned at the same distance and at the same orientation relative to the microphone 360 without the acoustic coupler 370 in-between the two components in the same ambient environment conditions (same background noise, same temperature, same humidity, same atmospheric pressure, same airflow directions and magnitudes, same acoustic reflectance from/acoustic absorption by structure, same any other phenomenon that would impact the acoustic quality, etc.). Accordingly, in an exemplary embodiment, an acoustic quality of sound generated by the speaker of the earphone ear interface 380 that is received by the microphone of the BTE device is enhanced relative to that which would be exhibited for the same output from the speaker of the earphone ear interface 380 if the earphone ear interface 380 was positioned at the same distance and at the same orientation relative to the microphone 360 without the acoustic coupler 370 in-between the two components in the same ambient environment conditions. It is noted that in some embodiments, acoustic quality may be measured in terms of one or more of volume, attenuation, sound energy, sound energy density, sound intensity, sound level, sound power, sound power level, speech intelligibility, signal to noise ratio, etc., and these qualities may be enhanced/changed/adjusted, etc., upward or downward as detailed herein (e.g., volume increased, signal to noise ratio decreased, etc.). More specific performance features are detailed below.

In an exemplary embodiment, the acoustic coupling may form an acoustic seal between, on the one hand, the earphone ear interface 380 in general, and the speaker thereof in particular, and, on the other hand, the BTE device 360 in general, and the microphone 362 thereof in particular. It is noted that some embodiments may be practiced without such a seal providing that a desired performance feature is met (e.g., the just-mentioned enhancement is achieved). In some embodiments, the acoustic seal will correspond to that and/or about that which may be formed during normal use of the earphone ear interface with a human ear, as will be detailed further below. It is noted that in other embodiments, no acoustic seal may be established.

The mechanical coupling formed by the acoustic coupler 370 may substantially retain the earphone ear interface to which it is configured to interface to the acoustic coupler 370, and the acoustic coupler 370, along with the earphone ear interface, may be substantially retained to the BTE device when the collective components are subjected to an upward and/or downward and/or horizontal forward and/or horizontal backward acceleration that corresponds to 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.5, 3.0, 3.5, 4.0, 5.0, 6.0, 7.0, 8.0, 9.0 and/or 10.0 G-forces, at least some of which may be experienced in the event of the recipient standing from a seated position and/or visa-versa, the recipient walking and/or running up or down stairs. Such G-forces may be experienced, for example, where the recipient is subjected to even greater accelerations, such as may be obtained in the event of the recipient jumping up or down (which may be experienced while running, playing basketball, jumping, etc.). In an exemplary embodiment, the acoustic coupler is configured to retain the earphone ear interface to a given component of the coupler under an acceleration of the acoustic coupler of one or more of the above G-forces in a first direction along a longitudinal axis of the cavity and in an opposite direction to the first direction.

It is noted that in the embodiments detailed herein, the couplings detailed herein and/or variations thereof are configured for use while the BTE device is worn behind the ear of the recipient and/or while the BTE device is operating to evoke a hearing percept by the implanted transducer (e.g., cochlear implant, bone conduction device, middle-ear implant, etc.).

Performance features of the acoustic seal will be detailed below. Unless otherwise stated, all embodiments of the acoustic coupler detailed herein and/or variations thereof and/or the mating components therewith are configured to meet some and/or all of the performance features detailed herein.

Figure 4A:
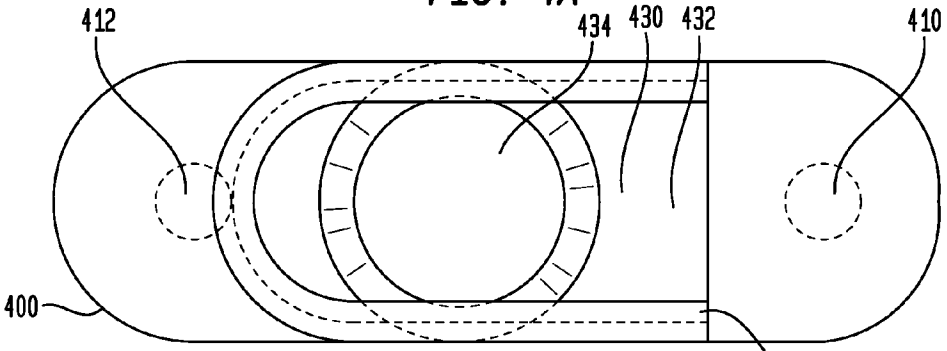
FIGS. 4A and 4B depict an exemplary acoustic coupler in accordance with an exemplary embodiment of the present invention.
Figure 4B:
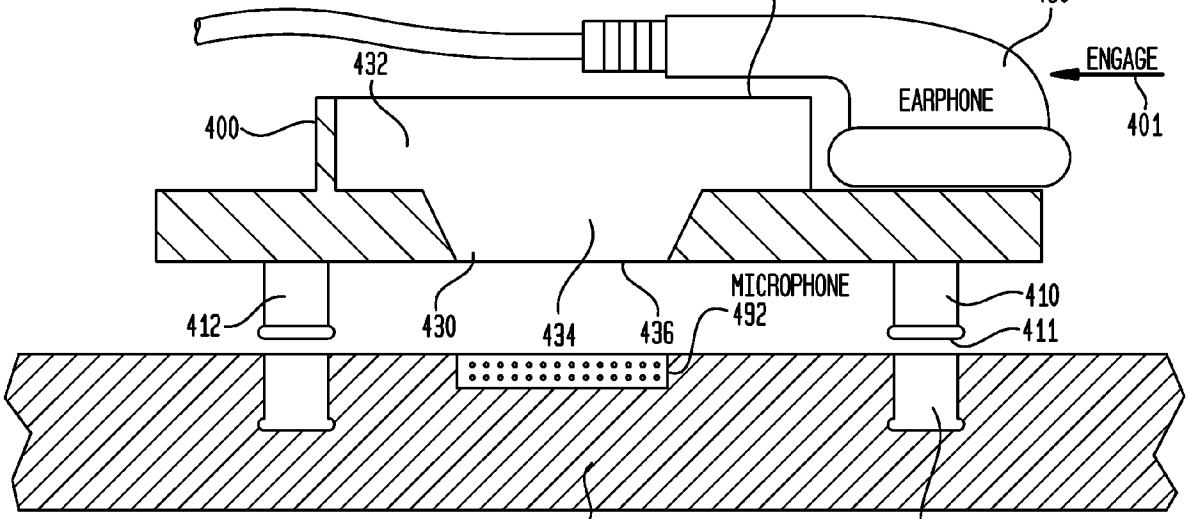

FIGS. 4A and 4B depict an example of an acoustic coupler 400 functionally corresponding to acoustic coupler 370, details of which will now be described.

FIG. 4A presents a top view, and FIG. 4B presents a side view, of an exemplary embodiment of the acoustic coupler 400. FIG. 4B additionally depicts BTE device 490 with microphone 492, and a standard equipment earphone ear interface 480 of an earphone (corresponding to that of FIG. 2A). These elements are not shown in FIG. 4A. BTE device 490 functionally and/or structurally may conform to any of the BTE devices detailed herein and/or variations thereof. By way of example and not by way of limitation, the coupler 400 may be made of a sufficiently elastic and/or plastic material and be dimensioned so as to deform and/or fit snugly against the mating components of the BTE device 490 and the earphone ear interface 480 so as to achieve the performance features detailed herein and/or variations thereof. By such deformation/fitting, the substantial acoustic seal detailed herein and/or variations thereof may be achieved. It is noted that in other embodiments, instead of or in addition to the use of elastic and or plastic materials to form an interference fit between the coupler 400 and the earphone ear interface 480, a positive retention system may be used, such as, for example, a strap that extends about the earphone ear interface 480, as will be described further below.

Briefly, acoustic coupler 400 and/or other embodiments of acoustic couplers detailed herein and/or variations thereof can be made of silicone, polyethylene, polyurethane, PVC, rubber, and other elastic and/or plastic polymers, and other elastic and/or plastic materials some of which can adhere to one or both of the BTE device 490 and the earphone ear interface 480.

The acoustic coupler 400 of FIGS. 4A and 4B includes an earphone receptacle 420 formed therein that can slidingly engage an earphone ear interface 480 in the coupler 400, e.g., by friction and/or by an interference fit about an area above the earphone lip 482. In the exemplary embodiment of FIGS. 4A and 4B, the earphone ear interface 480 is slid in the direction of arrow 401. Because the outer diameter of earphone ear interface 480 is larger than the inner mating diameter of the earphone receptacle 420, and because the material of the receptacle 420 is elastically and/or plastically deformable, the position of the earphone ear interface 480 relative to the receptacle 420 may be held generally constant during normal use and extra-normal use (e.g., walking up or down stairs, running, sitting down, etc.)

More specifically, the acoustic coupler 400 includes two coupler securing features 410 and 412 configured to releasably secure the coupler 400 to BTE device 490. FIGS. 4A and 4B depict each securing feature as a post 410, 412, configured to mate with respective holes 494 in the BTE 490. Securing features 410 and 412 include securing feature lip 411 that can mate with a corresponding opposite) feature in hole 494. Accordingly, the acoustic coupler 400 may be snap-fitted to BTE device 490. Any device, system and/or method that will permit acoustic coupler 400 to removably fit to BTE device 490 may be used in some embodiments detailed herein and/or variations thereof, including, by way of example and not by way of limitation, interference fit, snap-fit, positive retention (e.g., use of screws or the like), hooks, adhesive, etc.

Acoustic coupler 400 includes an open space/cavity 430 that extends completely through (i.e., forms an opening at the top and bottom) of acoustic coupler 400. Cavity 430 includes two sub-cavities 432 and 434. Sub-cavity 432 is located on the side of the coupler 400 facing away from the BTE device 490, and is configured to interface with the sides of the earphone ear interface 480 and thus form earphone receptacle 420. In this regard, sub-cavity 432 has pertinent diameters that are substantially the same as the mating respective diameters of earphone ear interface 480. Sub-cavity 434 is located on the side of the coupler 400 facing the BTE device 490, and has a bottom area 436 that is substantially the same size and/or the same geometry as the surface area of the BTE device microphone 492. In an exemplary embodiment, the bottom area may extend beyond the surface area of the microphone 492. As used herein, the phrase "microphone area" refers to the area of the BTE device with which the coupler interfaces, whether it be limited to the area of the microphone or inclusive of the area of the microphone and area of the BTE device housing about the microphone. In some embodiments, to the extent that the earphone ear interface and the BTE device microphone area differ from the relative proportions depicted in FIGS. 4A and 4B, the geometries of cavity 430 may likewise change uniformly.

In some embodiments, including the embodiment illustrated in FIGS. 4A and 4B, the earphone receptacle 420, the coupler securing features 410 and 412, and the cavity 430 are located with respect to the BTE device holes 494 to position the cavity bottom area 434 directly over the BTE device microphone 492 as a result of attachment of the coupler to the BTE device 490.

Figure 5:
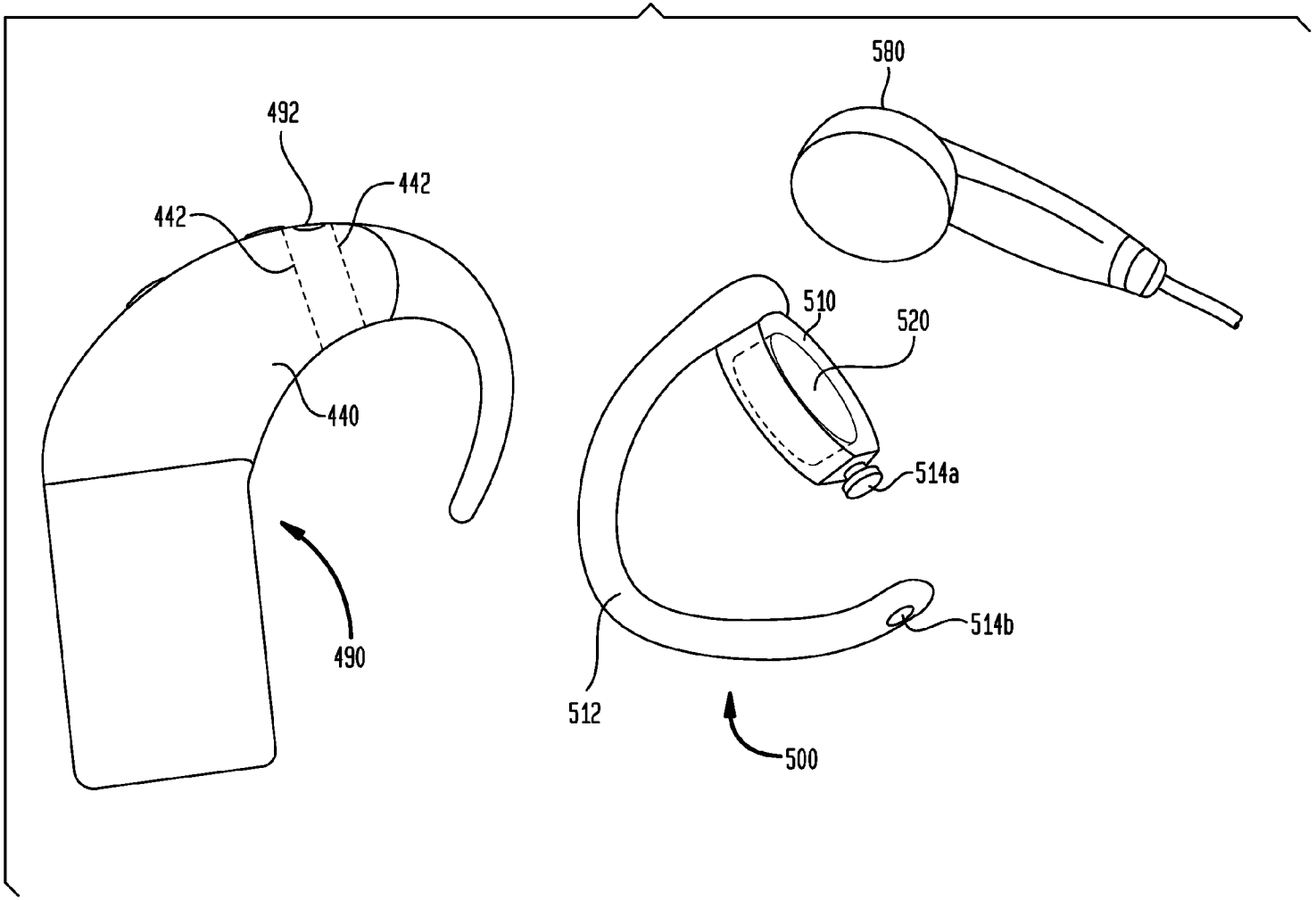
FIG. 5 depicts a BTE device, an acoustic coupler and a portion of an earphone in accordance with an exemplary embodiment of the present invention.

FIG. 5 depicts an alternate embodiment of an acoustic coupler 500 of the present technology that uses an alternate configuration to mechanically connect to a BTE device. The acoustic coupler 500 includes a male clasp portion 514*a* and strap 512 with a female clasp portion 514*b*. These components correspond to a coupler securing feature for securing the coupler 500 to BTE device 490. As may be seen, male clasp portion 514*a* is formed on a side of a coupler body 510, and female clasp portion 514*b* is located at about the end of the strap 512. In alternate embodiments, the locations of the male portion 514*a* and female portion 514*b* of the clasp may be reversed (i.e., the male portion 514*a* can be located at an end of the strap 512, and the female portion 514*b* can be a feature on the coupler body 510).

The coupler 500 includes a cavity 520 that functionally corresponds to the cavity of FIGS. 4A-4B. Cavity 520 extends from the side of the coupler that faces away from the BTE device when positioned thereon to the opposite side of the BTE device 500, with openings at either end. Cavity 520 is dimensioned and made of materials so as to removably receive the earphone ear interface 580 therein in a manner similar to and/or the same detailed above with respect to coupler 400. In this regard, it is noted that cavity 520 is annular and configured to extend completely around earphone ear interface 580 (as opposed to the cavity of FIGS. 4A and 4B, which only extended partially about the ear interface 580. As with coupler 400, coupler 500 is dimensioned and/or made of material such that cavity 520 is acoustically sealed off from the external environment (i.e., the earphone ear interface 580 is acoustically sealed to the microphone 492 of the BTE device 490).

Figure 6B:
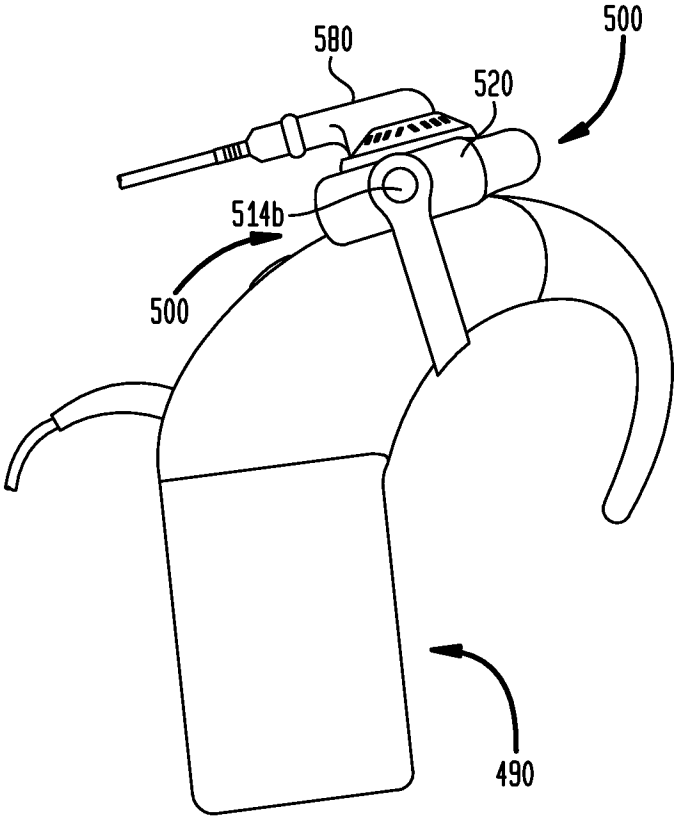
FIGS. 6A and 6B depict an alternate embodiment of the present invention.
Figure 6A:
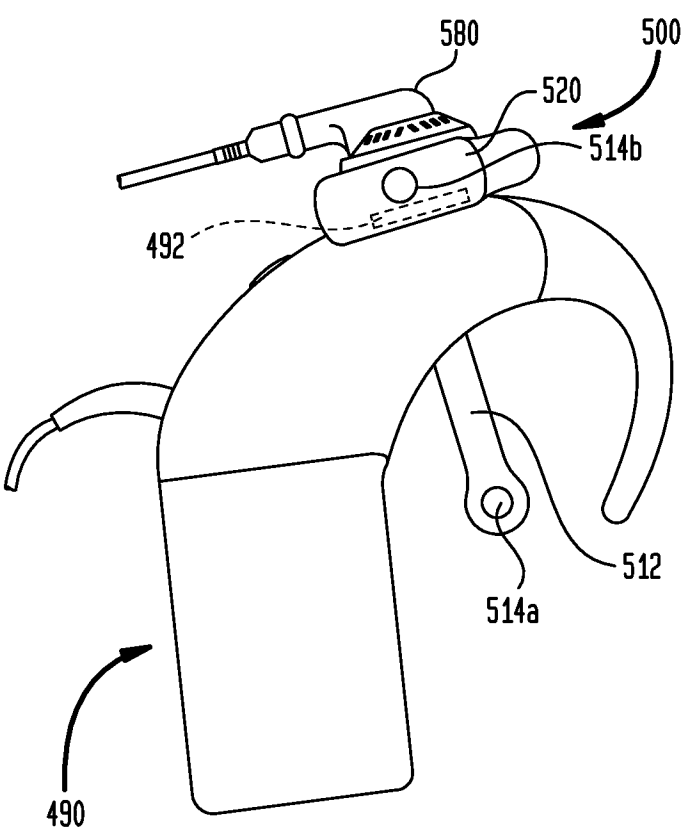

In the exemplary embodiment of FIG. 5, the recipient may position the strap 512 around the back 440 of BTE 490 at about the location between dashed lines 442. The strap 512 is dimensioned and made of a material such that it retains itself (along with the earphone ear interface 580) to the BTE device 490 when the clasp components are clasped together. FIGS. 6A and 6B illustrate such positioning and coupling. Referring to FIG. 6A, acoustic coupler 500 is shown with earphone ear interface 580 secured in earphone cavity 520. Accordingly, in an exemplary method, a recipient obtains a coupler 500 and places an earphone ear interface in the cavity 520 such that it is removably secured as detailed herein and/or variations thereof. The recipient then places the coupler 500 against the BTE device 490 such that the cavity is aligned with the microphone 492 as depicted in FIG. 6A. Next, the recipient wraps strap 512 around the spine of the BTE device 490 and activates the clasp so as to removably secure the coupler 500 (and thus the earphone ear interface 580) to the BTE device 490 as depicted in FIG. 6B. In an alternate embodiment, the recipient may first attach the coupler 500 on the BTE device, and then attach the earphone ear interface to the coupler 500.

It is noted that in other embodiments, other devices other than clasps may be used. Any device, system and/or method of retaining the acoustic coupler 500 (or other acoustic coupler detailed herein and/or variations thereof) to achieve the performance specifications detailed herein may be used in some embodiments. By way of example, a buckle may be used. A twist tie system may be used. A magnetic connection may be used. Hooks and/or loops may be used. A ratchet system may be used, etc.

In this regard, in some embodiments, straps may be used that will enable the tension thereon to be adjusted. For example, straps utilizing a ratchet system enable a recipient to adjust the tension on the strap. This may influence the quality of the acoustic seal formed by the coupler 500 (more tension may mean a better acoustic seal). Such ability to adjust the strap may permit different couplers 500 to fit onto different BTE devices and/or may account for temporary or permanent material deformation of the coupler 500 or of the mating components due to environmental conditions (e.g., change in humidity, temperature, exposure to sunlight, exposure to increases shock (e.g., due to running, etc.)) and/or aging, etc.

It is further noted that in alternate embodiments, a strap configuration may be utilized to positively retain the earphone ear interface 580 to the acoustic coupler 500. Such a strap may be akin to the strap 512 depicted in FIG. 5. In this regard, a second strap may be included on acoustic coupler 500, where the second strap extends away from the BTE device 500. In an alternate embodiment, a single strap may be used to connect all three components together. Alternate embodiments may utilize a C-clamp or a U-clamp that extends about the earphone ear interface 580 to positively retain the earphone ear interface 580 to the coupler 500. In the same vein, such claims may be used instead of the strap 512.

Some exemplary alternate embodiments will now be described. It is noted that any one or more than one feature of any embodiment detailed herein and/or variation thereof may be combined with any one or more other feature of the other embodiments detailed herein and/or variations thereof.

In an alternate embodiment, the acoustic coupler device is configured such that it interfaces with a sub-component of the earphone ear interface (e.g., an eartip of a canal earplug earphone according to FIG. 2B) and/or it is retained to the BTE device utilizing an elastic ring. Specifically, referring to FIG. 7A, BTE device 490 is show with an acoustic coupler 700 installed thereon. The acoustic coupler 700 includes an elastic ring 710 that elastically deforms to provide an interference fit about the spine of the BTE device 490. In the exemplary embodiment of FIG. 7A, the coupler 700 can be installed by slipping the securing feature 710 over the earhook 180/end of the BTE device 490 to a position proximate the cavity 720 of the coupler 700 directly over the BTE device microphone 492.

Figures 7A, 7B, 7C:
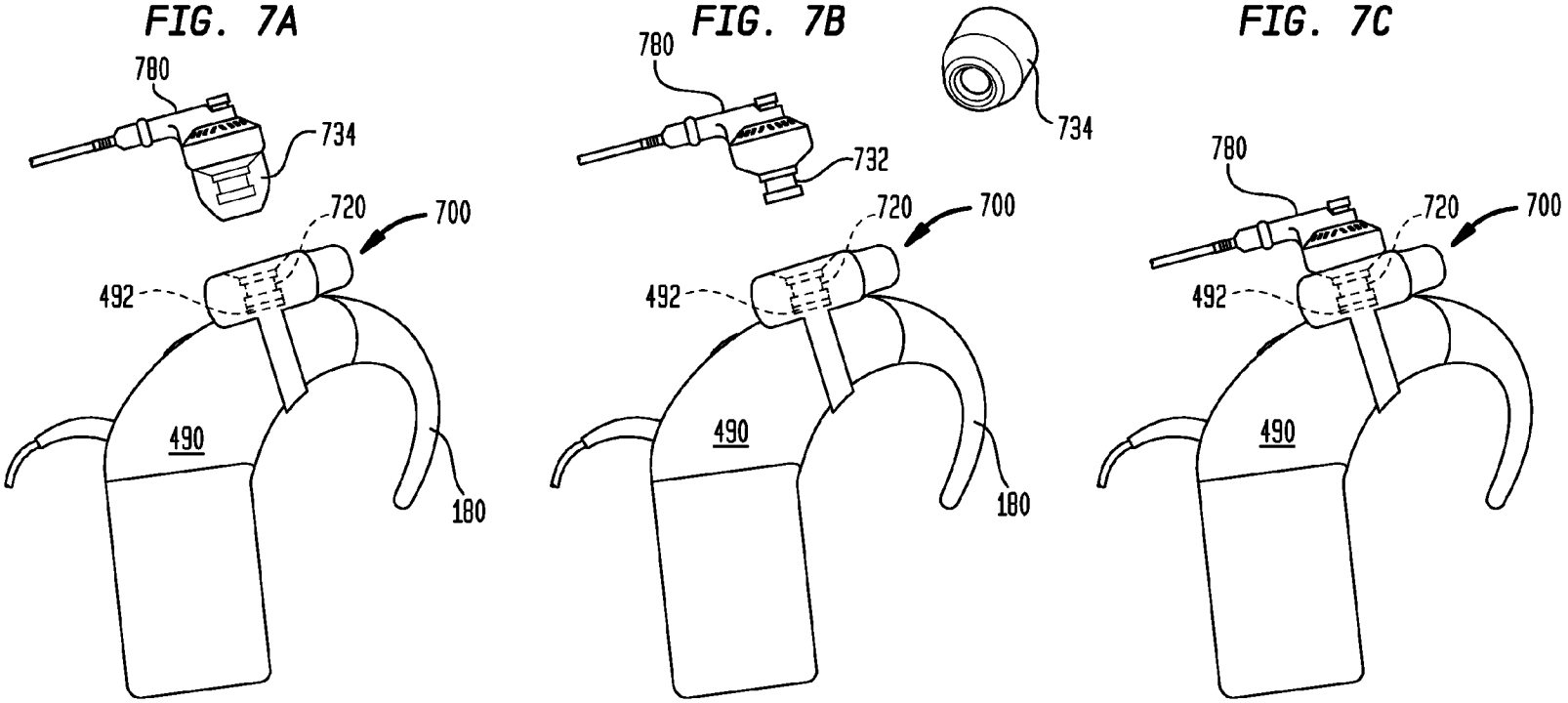
FIGS. 7A, 7B and 7C depict another alternate embodiment of the present invention.

As may be seen in FIG. 7A, the earphone ear interface 780 includes an eartip 734 prior to connection to the acoustic coupler 700. Eartip 734 corresponds to eartip 732 as detailed above, and is thus configured to fit into the outer ear canal of a recipient. During use, before or after the acoustic coupler 700 is attached to the BTE device, the eartip 734 is removed from the ear interface 780, as may be seen in FIG. 7B, thus revealing the base 732, which is configured to form an interference fit with the eartip 734 to hold the eartip 734 thereto. Thus, simply overcoming the interference fit between the two components permits the base 732 to be revealed.

The cavity 720 of the acoustic coupler 700 has an inner profile that substantially conforms to the outer profile of the base 732. In an exemplary embodiment, the cavity 720 establishes an interference fit with the base 732 so as to retain the base 732, and thus the earphone ear interface 780 (at least the remaining sub-component(s) thereof) to the coupler 700, as may be seen in FIG. 7C. In the exemplary embodiment of FIGS. 7A-7C, an acoustic seal is established between base 732 and the BTE 490.

It is noted that in an alternate embodiment, the cavity 270 may be configured to instead conform to the eartip 734, thus permitting the recipient to place the entire earphone ear interface on the acoustic coupler 700.

Figure 8B:
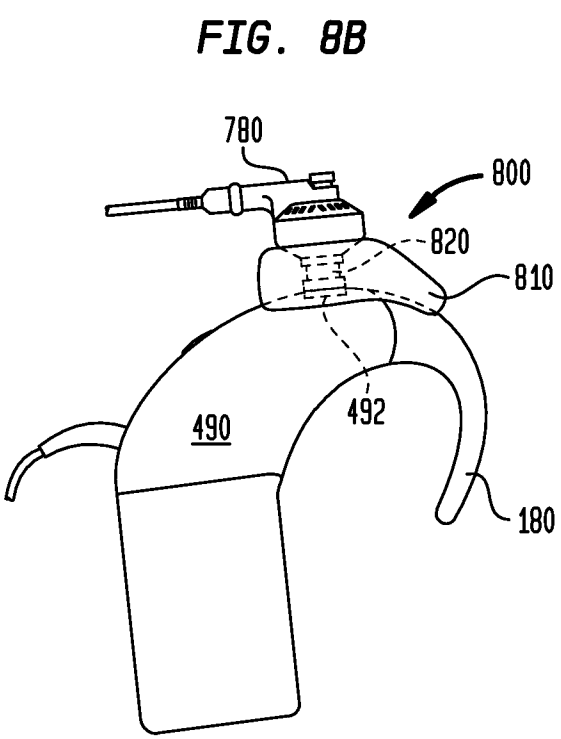
FIGS. 8A and 8B depict another alternate embodiment of the present invention.
Figure 8A:
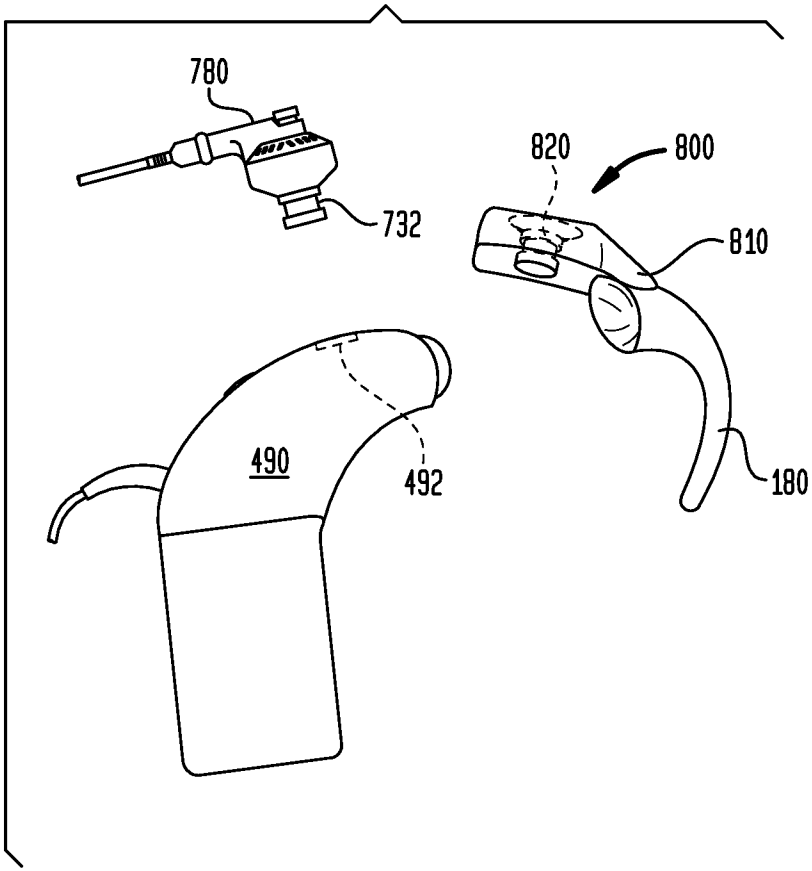

In an alternate embodiment, the acoustic coupler is attached to another component of the BTE device other than those depicted above. More specifically, referring to FIG. 8A, a BTE device 490 is shown with the earhook 180 thereof detached from the device, and with an acoustic coupler 800 secured to the earhook 180 via extension 810 of the acoustic coupler 800, although in other embodiments, the extension may be part of the earhook and or a separate component, such as a tether or the like. In the embodiment of FIG. 8A, acoustic coupler 800 includes a cavity 820 shaped as described in any of the embodiments detailed herein and/or variations thereof to engage an earphone ear interface component or a sub-component thereof of an earphone, wherein with respect to FIG. 8A, the sub-component is base 732 of the earphone ear interface detailed above with respect to FIG. 7A.

In the embodiment of FIG. 8A, the extension of FIG. 8A is configured to position the cavity 820 proximate the microphone 492 of the BTE device 490 when the earhook 180 is attached thereto at its normal location, thus freeing the recipient from any need to more accurately position the acoustic coupler 800 relative to the microphone. In this regard, FIG. 8B illustrates acoustic coupler 800 positioned directly over microphone 492 as a result of normal attachment of the earhook 180 thereto.

Figure 9C:
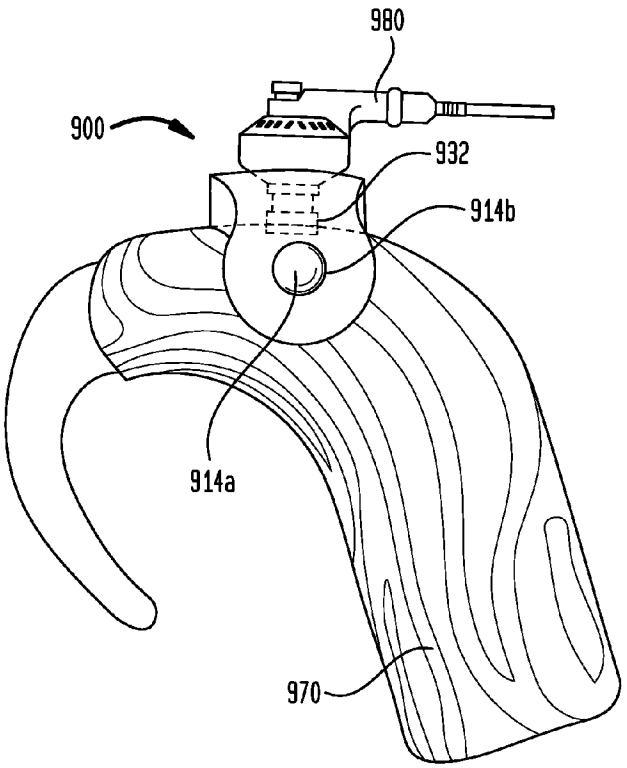
FIGS. 9A, 9B and 9C depict another alternate embodiment of the present invention.
Figure 9A:
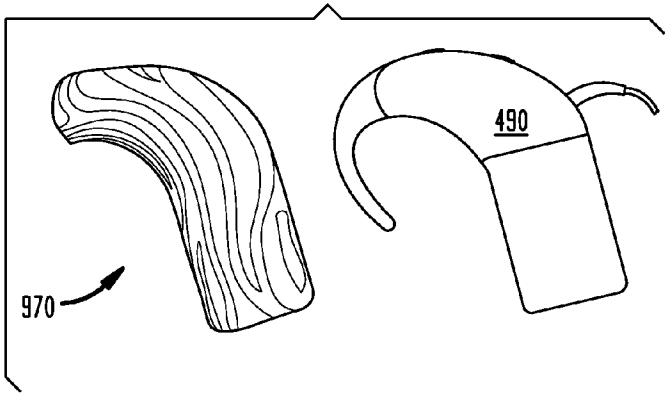

As detailed above, some embodiments of the acoustic couplers detailed herein utilize a strap or the like to attach to the BTE device. In an alternate embodiment, the acoustic coupler includes a component that extends about most of the BTE device in the form of a BTE device "skin," and the skin is used to connect or otherwise retain the acoustic coupler to the BTE device. FIG. 9A illustrates a BTE device 490 and a skin 970 that may be attached to the BTE device 490. In this regard, skin 970 may have a U-shape cross-section such that the skin 490 extends around the BTE device as depicted in FIG. 9C. In an exemplary embodiment, the skin 490 is a hard shell that snaps around BTE device to for an interference fit. In an alternate exemplary embodiment, the skin is a flexible material that can be wrapped about or stretched about the BTE device. The skin 970 may be installed on the BTE device 490 by sliding it upward onto the BTE device 490.

Figure 9B:
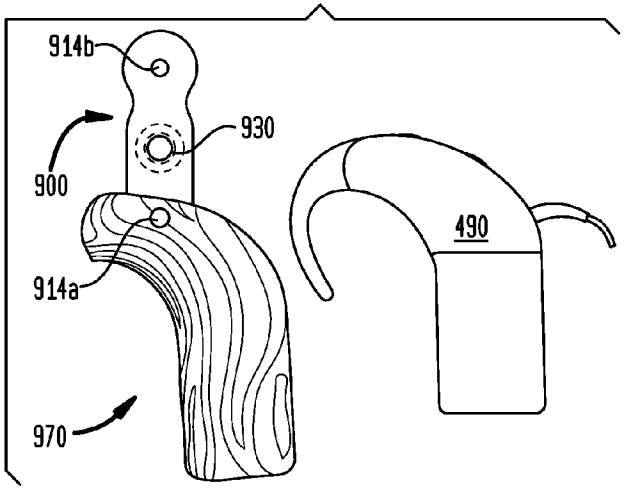

FIG. 9B illustrates an acoustic coupler 900 including skin 970 and cavity 930 formed in an extension from the skin. A first end of the extension may be attached to the skin 970 in any of a variety of fashions, with the second end of the extension having a male component 914*b* of a snap coupling attached thereto that interfaces with a female component 914*a* of a snap coupling attached to the skin 970. In use, once the skin 970 is properly attached to the BTE device, the recipient deforms the flexible extension to snap couple the male and female portions of the snap coupling together, as depicted in FIG. 9C, thus bring cavity 930 proximate to speaker 490 of the BTE device contained in the skin 970 (the earhook of which is shown extending from skin 970 in FIG. 9C).

The cavity 930 of acoustic coupler 900 may be shaped as described in any of the embodiments detailed herein and/or variations thereof to engage an earphone ear interface component or a sub-component thereof of an earphone, wherein with respect to FIGS. 9A-9C, the sub-component is base 932 of an earphone ear interface corresponding to base 732 detailed above with respect to FIG. 7A. Upon positioning of the cavity 930 proximate the microphone 492 of the BTE device 490 and upon positioning the base 932 as depicted in FIG. 9C, an acoustic seal is established between the base 932 and the BTE device 490. Attachment of the base 932 may be in accordance with the description of attachment of the base 732 to the BTE device as detailed above.

Figure 10A:
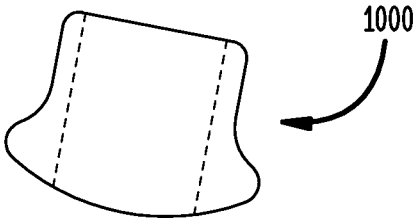
FIGS. 10A-10C depict another alternate embodiment of the present invention.
Figure 10B:
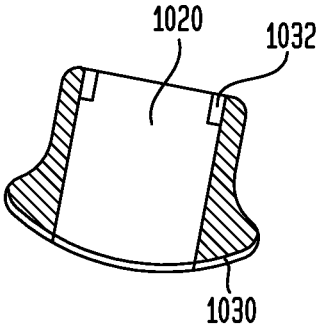
Figure 10C:
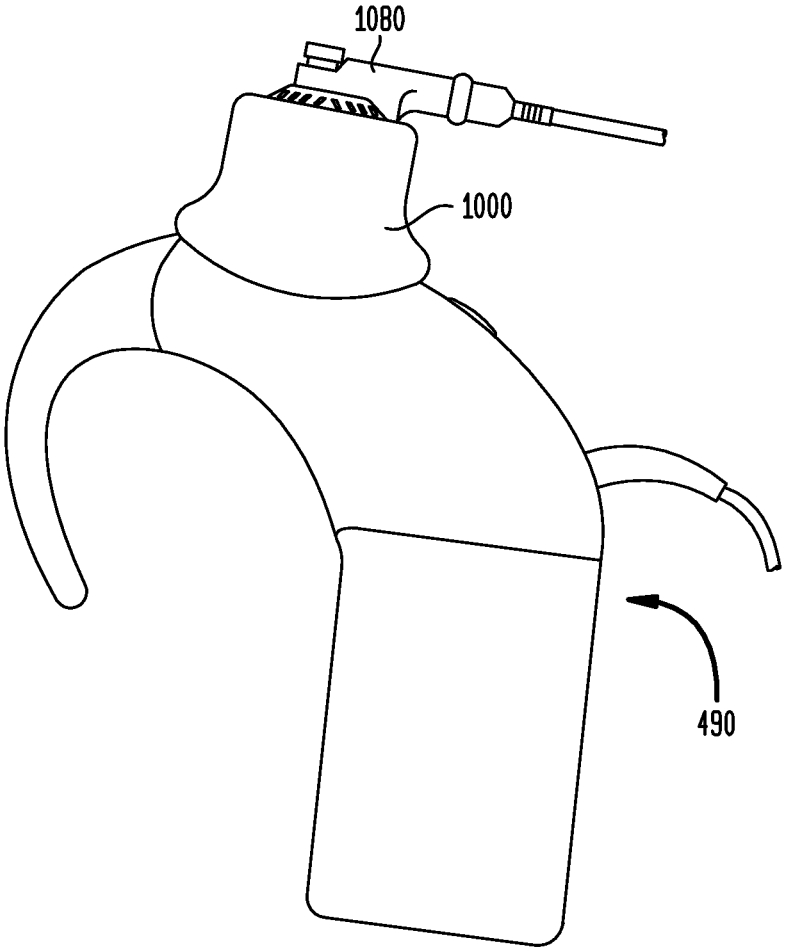

Other embodiments include alternate systems of attaching the earphone ear interface component to the BTE device to establish an acoustic seal. For example, FIG. 10A illustrates embodiments of an acoustic coupler 1000. FIG. 10B depicts a cross-sectional view of the coupler of FIG. 10A, depicting a cavity extending along the longitudinal axis thereof from the interface of the earphone ear interface (top portion) to the interface of the BTE device 490 (bottom portion). In such embodiments, either one or both of the coupling between the earphone ear interface and the coupler 1000, and the coupler 1000 and the BTE device 490 can be adhesive (and, optionally, elastically and/or plastically deformable as detailed herein to also establish an interference fit) and forms a substantial acoustic seal between the earphone ear interface and the BTE device (specifically, the microphone of the BTE device). In this regard, FIG. 10B depicts adhesive layer 1030 located at the BTE device interface portion of the coupling 1000, and an adhesive layer 1032 at the interface of the earphone ear interface. FIG. 10C depicts use of the coupling 1000 to couple BTE device 490 to earphone ear interface 1080. In some alternate embodiments, the coupler 1000 is sealed to one or both of the earphone 1080 and the BTE device 490 as a result of suction/negative pressure gradient between the ambient atmosphere and an atmosphere within the resulting cavity of coupler 1000, instead of or in addition to the use of adhesive and/or instead of or in addition to the other types of fits detailed above. Such may be established by gently squeezing the coupler 1000 while it is engaging the BTE device 490 and/or the earphone 1080.

Figure 11A:
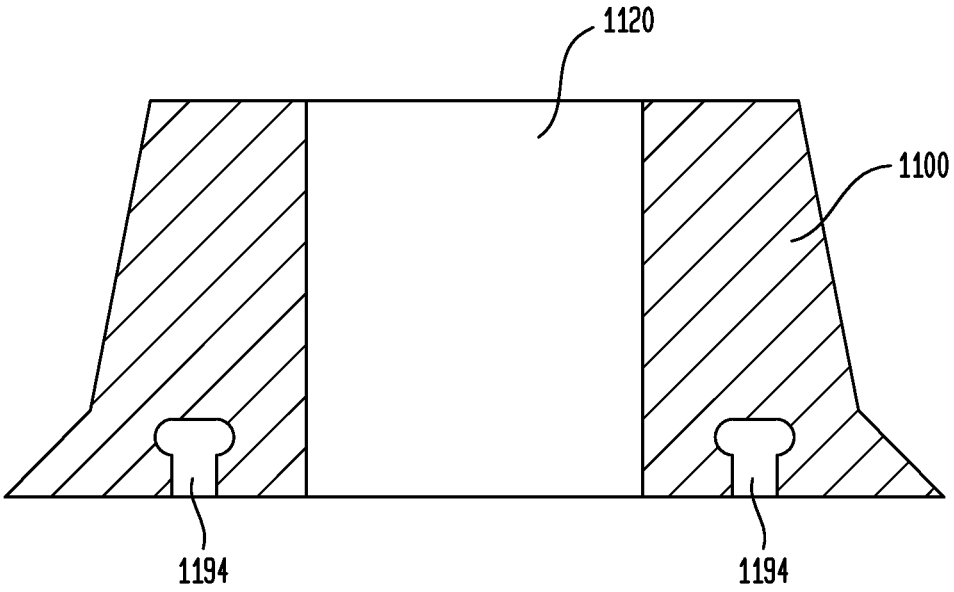
FIGS. 11A-11D depict variations of other alternate embodiments of the present invention.
Figure 11B:
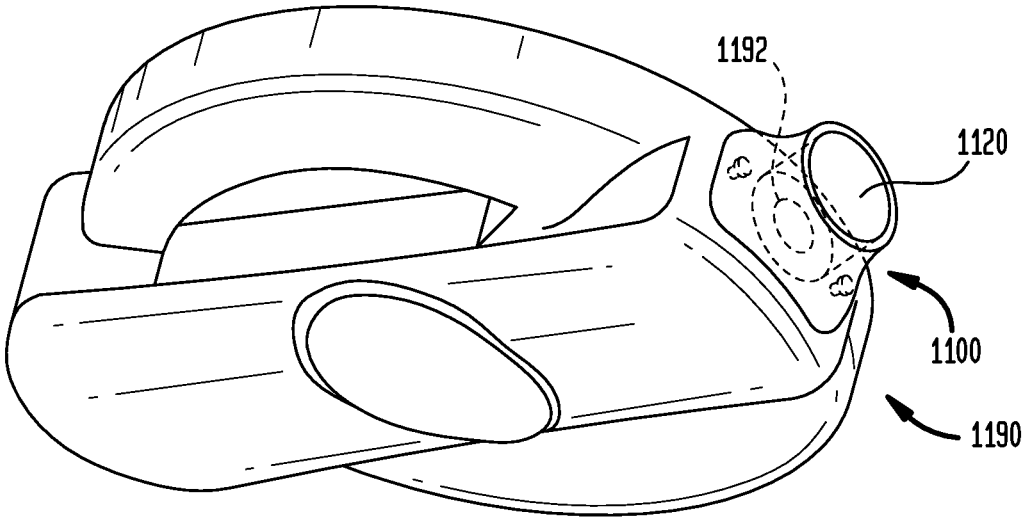

As detailed above, acoustic couplers of some embodiments may also be applicable to external components other than BTE devices, such as the external component of 190 of FIG. 1B. In this regard, FIG. 11A depicts a cross-sectional view of an acoustic coupler 1100 configured to interface with a button sound processor 1190 as depicted in FIG. 11B, where button sound processor 1190 corresponds to external component 190 of FIG. 1B. As may be seen from FIGS. 11A and 11B, acoustic coupler 1100 has a cavity 1120 that extends from one side of the acoustic coupler 1100 to another side (the base—the part that interfaces with the button sound processor) of the acoustic coupler 1100. The cavity is configured to receive an ear interface component of a canal earplug earphone (e.g., component 230 of FIG. 2B) in a manner that, in some embodiments, is similar to that depicted above with respect to FIGS. 10A and 10B and/or one or more of any other embodiments detailed herein and/or variations thereof. It is noted that in some embodiments, the cavity 1121 may be configured to receive base 232 and/or eartip 234 of the ear canal earplug earphone. FIG. 11B depicts the acoustic coupler removably attached to button sound processor 1190. Specifically, the acoustic coupler 1100 includes holes 1194 as shown in FIG. 11A that interface with respective posts on the outer surface of the button sound processor 1190 so as to position the cavity 1120 over/proximate microphone 1192 of the button sound processor. It is noted that while the embodiment of FIGS. 11A and 11B are described in terms of the posts being located on the button sound processor 1190, in other embodiments, the posts may be on the acoustic coupling 1100 and the holes 1194 may be in the button sound processor 1190. In an alternate embodiment, a strap may extend about the outer circular periphery of the button sound processor 1190 so as to removably attach the acoustic coupling 1192 to the button sound processor 1190. Any device, system and/or method of attaching the acoustic coupling 1192 and/or alternate variations thereof to the button sound processor 1190 so as to practice some and/or all of the teachings herein may be utilized in some embodiments of the invention.

It is noted that while the bottom (base) of the acoustic coupling 1100 is depicted has having a planar surface, in other embodiments, the base surface may be contoured to match or generally match the curved side of the button sound processor 1190. The embodiment of FIG. 11A is such that the acoustic coupler is sufficiently flexible (elastically and/or plastically) that is can be flexed to conform to the curved surface of the button sound processor 1190. Alternatively, the bottom base may be such that it need not conform thereto. Instead, only a portion of the base may directly interface with the button sound processor, providing that the cavity may be positioned to sufficiently provide acoustic coupling according to the teachings herein and/or variations thereof.

Utilizing an acoustic coupling 1100 having a flat base may have utilitarian value in that the same acoustic coupling 1100 may be used for button sound processors having microphones arrayed about the circular side thereof, such as that depicted in FIG. 11B, as well as used for button sound processors having microphones arrayed on the side opposite the skin facing side, such as the button sound processor 1191 of FIG.

11C. Indeed, in some embodiments, the same acoustic coupling 1100 may be used for BTE devices. In alternate embodiments, acoustic couplers having a curved/contoured base may be sufficiently flexible so as to conform to the generally flat surface of the button sound processor 1191, although in some embodiments, the surface of the button sound processor 1191 on which the microphone(s) 1192 are disposed may itself be curved.

Figure 11C:
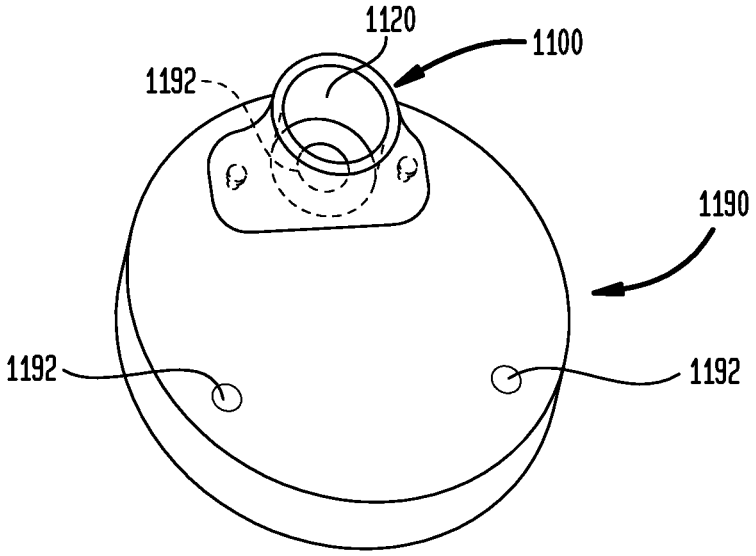

The button sound processors 1190 and 1191 of FIGS. 11B and 11C and/or variations thereof include three (3) microphones 1192, although only one may be seen in FIG. 11B. In the same vein, multiple microphones may also be located on the BTE devices detailed herein and/or variations thereof. While the embodiments detailed herein have been disclosed as having only one acoustic coupler that interfaces with only one microphone, in some alternate embodiments, multiple acoustic couplers may be utilized that are acoustically coupled to an earphone ear interface via an adapter may be utilized, thereby acoustically coupling two or three (i.e., with respect to the embodiment of FIGS. 11B and 11C, all microphones) or more microphones to the earphone ear interface. In an alternate embodiment, a single acoustic coupler may be sufficiently sized and dimensioned so as to acoustically couple two or three or more microphones to the earphone ear interface. This may correspond to a funnel-like component with the wide end that extends about the sides of the BTE device. In an exemplary embodiment at least applicable to the button sound processor of FIG. 11B where the microphones are arrayed about the circular side thereof, the funnel like component may have a lip or the like that extends about the end of the funnel on the interior thereof so as to provide clearance between the funnel wall and the microphones. In an alternate embodiment, the acoustic coupler may have a series of cavities in acoustical communication with one another and/or an interface of an earphone ear interface of the acoustical coupler that acoustically couple each microphone to the earphone ear interface. Any device, system and/or method that will permit two or three or more or all microphones to be acoustically coupled to an earphone ear interface may be used in some embodiments.

Still, the embodiment of FIGS. 11B and 11C may have utilitarian value in that by only acoustically coupling one of the microphones/leaving at least one microphone unacoustically coupled to the earphone ear interface, the recipient may be able to hear ambient noises at an acoustic quality that is above that which would be the case if all microphones were acoustically coupled to the earphone ear interface, while still receiving sound from the earphone ear interface at an acoustic quality above that in the absence of the acoustic coupler. In this regard, the embodiment of FIGS. 11B and 11C and/or variations thereof that have one or more microphones acoustically coupled to the earphone ear interface and one or more microphones not so acoustically coupled may provide the "best of both worlds" with respect to ambient acoustic quality and acoustic quality from the earphone ear interface. Still further, in some embodiments, a recipient may be able to selectively activate and/or deactivate or otherwise control the hearing percept resulting from one or more microphones in a manner that permits the recipient to selectively listen to sound from the earphone ear interface and from the ambient environment without adjusting the earphone while still limiting and/or preventing interference from one or the other due to the presence of the earphone ear interface.

Figure 11D:
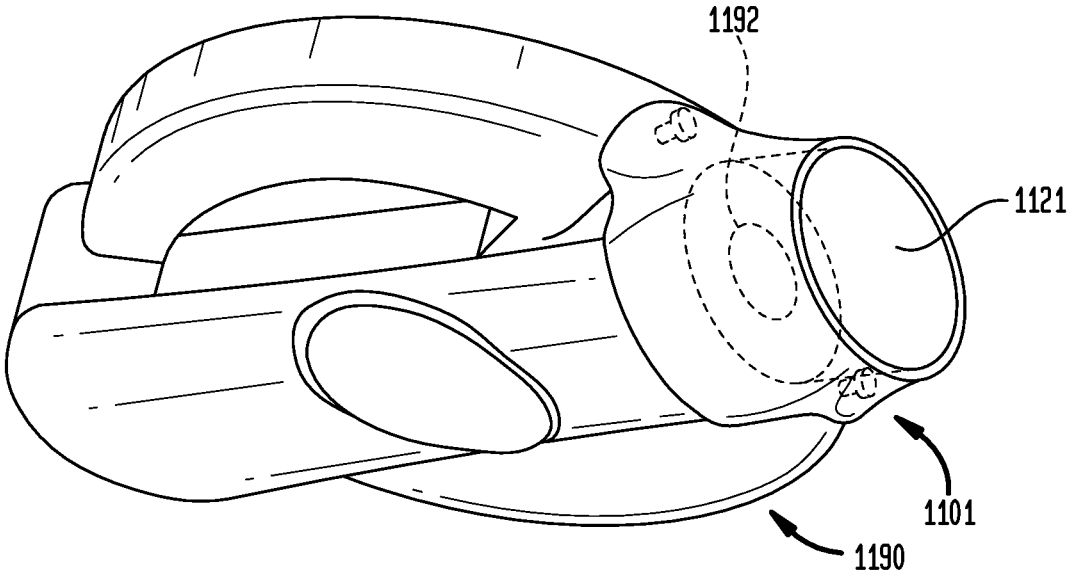

FIG. 11D presents an alternate embodiment of an acoustic coupler that generally corresponds to acoustic coupler 1100, except that it is sized and dimensioned to interface with an outer earphone such as the outer earphone 210 detailed above with respect to FIG. 2A. As may be seen from FIG. 11D, acoustic coupler 1101 has a cavity 1121 that extends from one side of the acoustic coupler 1101 to another side (the base—the part that interfaces with the button sound processor) of the acoustic coupler 1101. The cavity is configured to receive an ear interface component of an outer earphone in a manner that, in some embodiments, is similar to and/or the same as that depicted above with respect to FIGS. 10A and 10B and/or one or more of any other embodiments detailed herein and/or variations thereof. In this regard, cavity 1121 has a larger diameter than that of cavity 1120 of the embodiment of FIG. 11B. FIG. 11D depicts the acoustic coupler removably attached to button sound processor 1190. Specifically, the acoustic coupler 1101 can be removably attached to the button sound processor 1190 in a manner similar to and/or the same as that detailed above with respect to the embodiment of FIG. 11B.

It is noted that owing to the relatively larger size of acoustic coupler 1101 as compared to that of acoustic coupler 1100, and, more particularly, owing to the relatively larger sized base of the acoustic coupler 1101 as compared to that of acoustic coupler 1100, the base may be contoured to interface with other surfaces of the button sound processor 1190 that are relatively more complex than those that interface with the acoustic coupler 1100 of FIG. 11B (owing to the fact that the perimeter of the interfacing component of acoustic coupler 1101 is larger relative to that of acoustic coupler 1100). However, in other embodiments, the acoustic coupler may be configured such that the base has a footprint that is relatively the same as/is the same as that of acoustic coupler 1100.

Embodiments can include an acoustic coupler sized and dimensioned to interface with an outer earphone such as the outer earphone 210 detailed above with respect to FIG. 2A that further interfaces with the button sound processor in a manner similar to and/or the same as and/or otherwise analogous to that of embodiment of FIG. 11C, where the microphones are arrayed on the side opposite the skin facing side. In some embodiments, the acoustic coupler 1101 may be used to interface with the button sound processor having the microphones on the side facing away from the head. However, it is noted that owing to the contouring of the base of the acoustic coupler 1101 to interface with the more complex surfaces of the button sound processor 1190, a modified acoustic coupler 1101 might be utilized for embodiments corresponding to that of FIG. 11C. Such a modified acoustic coupler 1101 may have a base that is contoured differently than that of acoustic coupler 1101 so that it interfaces with the different interfacing surfaces of the button sound processor having microphones located as depicted in FIG. 11C. Still, in some embodiments, the same acoustic coupler 1101 may be usable for both sound processor configurations (i.e., that depicted in FIG. 11B and that depicted in 11C) to couple an outer earphone to the button sound processor.

Figure 12:
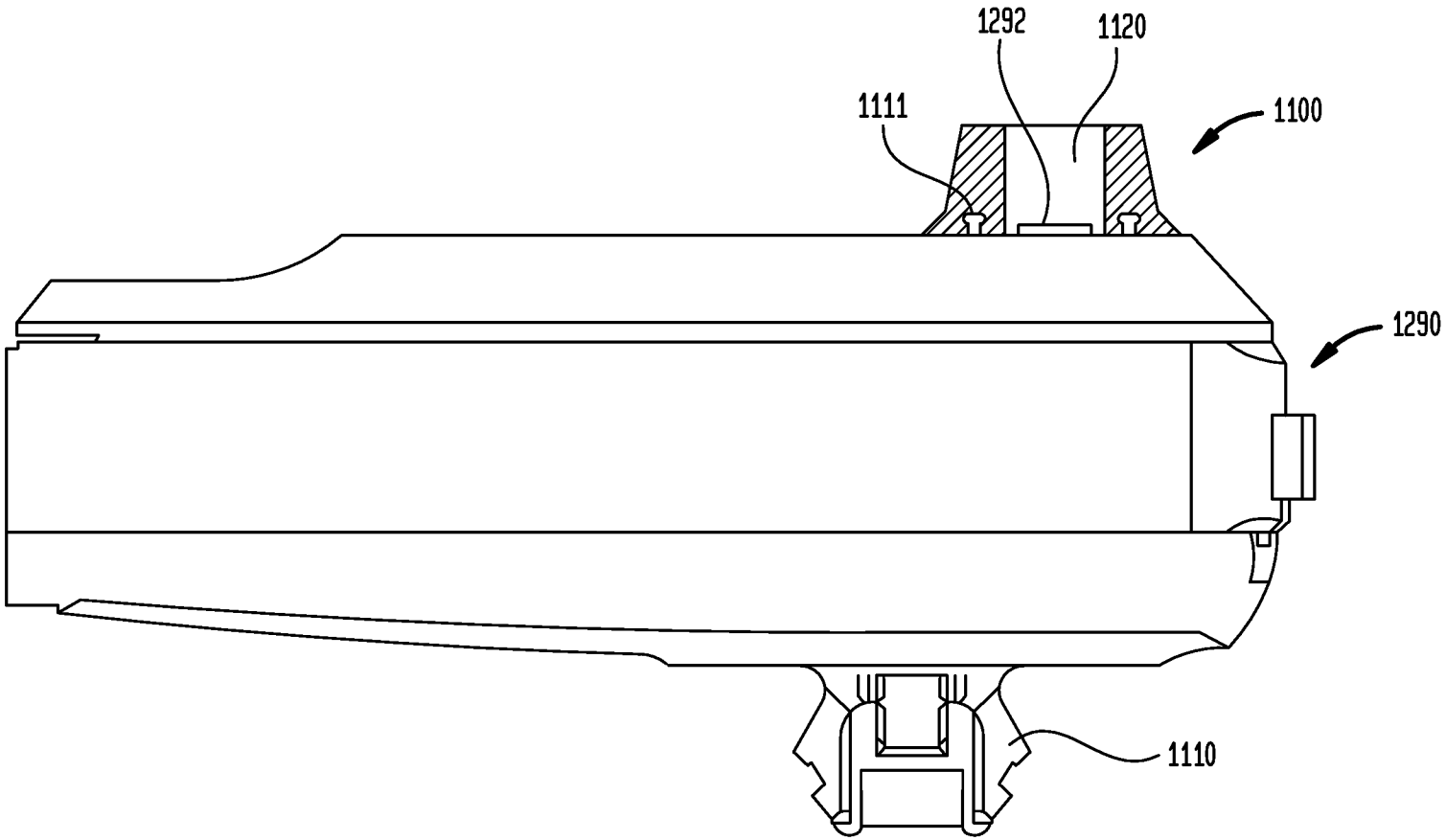
FIG. 12 depict use of the embodiment of FIGS. 11A-11C in an alternate application.

As noted above, some embodiments of the acoustic coupler as detailed herein and/or variations thereof may be applicable to bone conduction devices. In this regard, the BTE devices and the sound processor devices detailed above may also be applicable to active transcutaneous bone conduction devices. Still further, variations of these components, if not the components as detailed herein, may be applicable to passive transcutaneous bone conduction devices. Embodiments detailed herein may also be applicable to percutaneous bone conduction devices. In this regard, FIG. 12 depicts a removable component of a percutaneous bone conduction device 1290, which includes a vibrator enclosed therein (not shown). Coupling 1110 is configured to removably couple to a percutaneous abutment which is in-turn connected to a fixture implanted in bone of the recipient. Vibrations from the removable component are transferred from the coupling 1110 to the abutment and then to the bone fixture to evoke a hearing percept. External component 1290 may also include one or more microphones 1292 located on one or more of the faces of the external component 1290, as may be seen in FIG. 12. The acoustic coupler 1100 detailed above may be removably attached thereto to establish an acoustic coupling between the microphone 1292 and an earphone ear interface as detailed above and variations thereof. The embodiment of FIG. 12 depicts posts 1111 extending from the surface of the housing of the bone conduction device that interface with holes 1194 of the acoustic coupler 1100 to removably retain the acoustic coupler 1100 to the removable component 1290 of the bone conduction device. In some embodiments, alternate securement features may be used instead of or in addition to that depicted in FIG. 12, such as, by way of example only and not by way of limitation, a strap that extends about the external component. Any device, system and/or method of securing the acoustic coupler 1100 to the bone conduction device may be used in some embodiments detailed herein and/or variations thereof.

It is also noted that embodiments of the acoustic coupler detailed herein and/or variations thereof may be applicable to body worn sound processors or the like. Some embodiments may be applicable to any type of external component that may be usable with a hearing prosthesis.

Figure 13A:
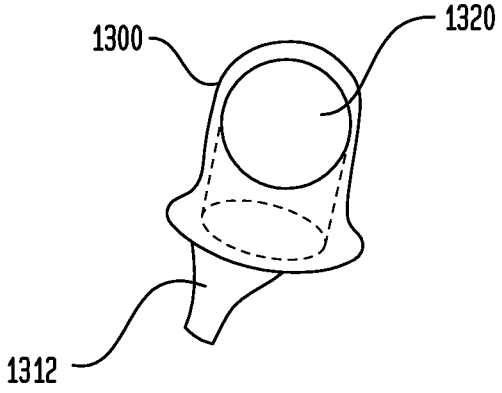
FIGS. 13A-13B depict another alternate embodiment of the present invention.

While in the embodiments detailed herein generally depict coaxial alignment of the cavities of the acoustic couplers with the microphones of the BTE devices detailed herein and/or variations thereof, other embodiments may have cavities that are offset (and thus the earphone ear interface, when connected thereto, may also be offset). In some embodiments, an extensive tube allows the earphone receptacle to be positioned further from the microphone while the securing feature can be as described elsewhere herein. In an exemplary embodiment, this may permit placement of the earphone ear interface at, for example, at a location proximate the bottom of the external device, with respect to the direction of gravity when the external device is worn on the recipient, such that, for example, the effects of earphone cables pulling around/down the external device, are minimized and/or the earphone ear interfaces are position at a more comfortable position relative to that which they may be positioned as detailed in some other embodiments. FIG. 13A depicts an acoustic coupler 1300 that enables side mounting of an earphone ear interface 1380, as may be seen in FIG. 13B. Cavity 1320 extends in a curved fashion through the interior of the acoustic coupling 1300. In this regard, in some embodiments, cavity 1320 extends in a manner akin to the cavity of a cowl vent (e.g., like that used on a boat). In this regard, the cavity extends along a first axis and then extends along a second axis orthogonal or about orthogonal to the first axis, or at another angle thereto. Other cavity geometries may be used as well (such as a cavity that extends along a first axis, extends along a second axis about orthogonal to the first axis, and then extends along a third axis that is orthogonal to the second axis, although in some other embodiments, the just recited orthogonal relationships may be substituted with alternate relationships of any other angle between the axes).

Figure 13B:
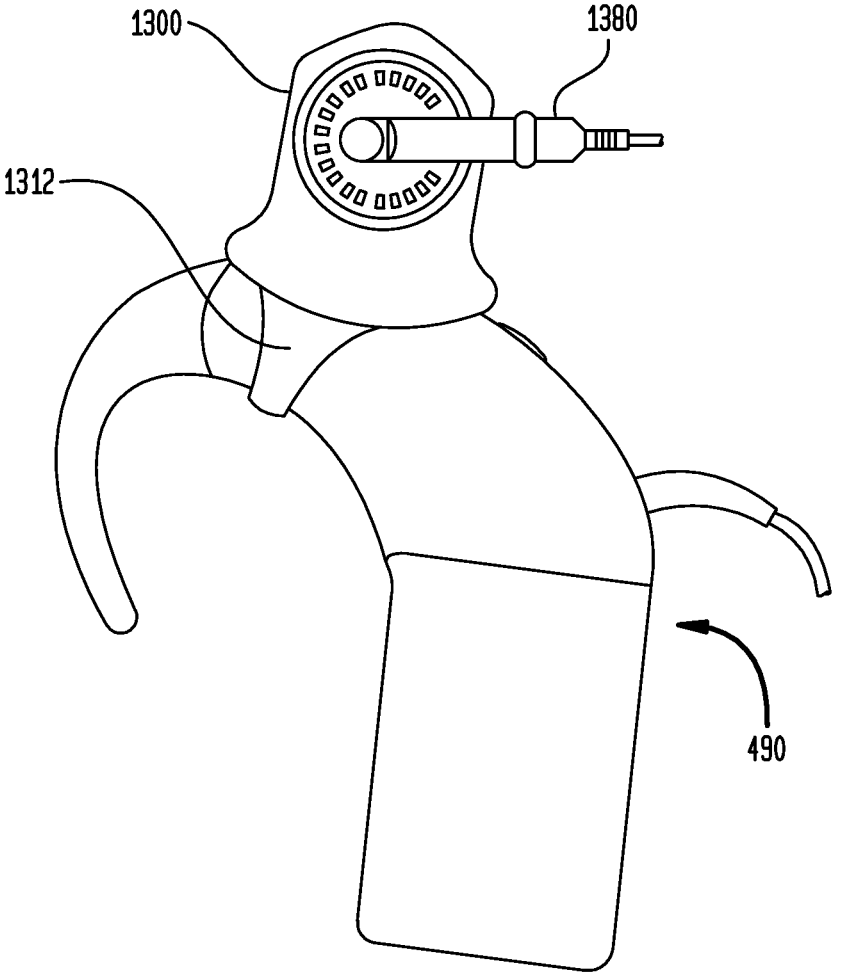

As may be seen in FIGS. 13A and 13B, the acoustic coupler 1300 includes a strap 1312 that retains the acoustic coupler about BTE device 490. When so positioned, the earphone ear interface 1390 is held to the side of the BTE device 490. In some alternate embodiments, some and or all the alternate coupling systems detailed herein and/or variations thereof may be used with the acoustic coupler 1300 instead of and/or in addition to the strap 1312 providing that the acoustic coupler may be removably retained to the BTE device or other applicable external component to achieve an acoustical coupling.

It is noted that embodiments detailed herein with respect to one type of external device (e.g., BTE device, button sound processor, etc.) may be applicable for use with other types of external devices with some or no modification in some alternate embodiments.

Any device, system and/or method to establish an acoustic seal may be used in some embodiments. Any device, system and/or method to establish a mechanical coupling between the earphone ear interface and the BTE device may be used in some embodiments.

It is noted that while the embodiments of the acoustic couplers detailed herein have been described as interfacing with a cushionless earphone ear interface, alternate embodiments of these embodiments and/or variations thereof may include an acoustic coupler that interfaces with a cushioned earphone ear interface.

It is noted that while the embodiments detailed herein have been depicted such that the acoustic coupler is a removably attachable component to the BTE device or to the earphone ear interface, in other embodiments, the acoustic coupler may be non-removable from one of those components. By way of example, the BTE device may have as an integral component thereof an acoustic coupler. Still further by way of example, an earphone may have the acoustic coupler as an integral component thereof (e.g., earphones may be manufactured and/or sold that have the acoustic coupler built in as a permanent feature and/or have the acoustic coupling as a removable feature). Along these lines, embodiments may include further alterations of standard earphone systems of those of FIGS. 2A-2C detailed above. By way of example, headphones of FIG. 2C may have adjustable arms and/or may be configured so as to adjust the position of one or both earphone ear interfaces along the arms. This may allow the earphone ear interface to be positioned at a different location to better interface with the BTE device or other external component of a hearing prosthesis. In an exemplary embodiment, there is a kit that includes adjustable arms and an acoustic coupler according to any of the embodiments detailed herein and/or variations thereof.

In some embodiments, acoustic couplers detailed herein and/or variations thereof enhance and/or change the overall acoustic quality and/or, or the acoustic quality as measured by any one or more than one of the above-identified acoustic quality measurements (volume, attenuation, sound energy, sound energy density, sound intensity, sound level, sound power, sound power level, speech intelligibility, signal to noise ratio, etc.), of sound generated by a speaker of an earphone ear interface that is received by a microphone of the external component to that which would be exhibited for the same output from the speaker of the earphone ear interface if the earphone ear interface was positioned at the same distance and at the same orientation relative to the microphone without the acoustic coupler in-between the two components in the same ambient environment conditions, by about 10% or more, about 20% or more, about 30% or more, about 40% or more, about 50% or more, about 60% or more, about 70% or more, about 80% or more, about 90% or more, and/or about 100% or more, and/or about 110% or more, and/or about 125% or more, and/or about 150% or more, and/or about 175% or more, and/or about 200% or more, and/or about 225% or more, and/or about 250% or more, and/or about 300% or more, and/or about 350% or more, and/or about 400% or more, and/or about 4540% or more, and/or about 500% or more, and/or about 550% or more, and/or about 600% or more, and/or about 650% or more, and/or about 700% or more, and/or about 800% or more, and/or about 900% or more, and/or about 1000% or more. In some embodiments, some and/or all of the qualities detailed herein may be enhanced/changed/adjusted, etc., upward or downward by these percentages (e.g., volume increased, signal to noise ratio decreased, etc.)

In some embodiments, the acoustic seal formed between the speaker of an earphone ear interface and the microphone 362 and/or the respective earphone ear interface and external component established by the acoustic coupler is about 50% or more, about 55% or more, about 60% or more, about 65% or more, about 70% or more, about 75% or more, about 80% or more, about 85% or more, about 90% or more, about 95% or more or about 100%, about 110% or more, about 125% or more, about 150% or more, about 175% or more, about 200% or more, about 225% or more, about 250% or more, about 300% or more, about 350% or more, about 400% or more, about 450% or more, about 500% or more, about 550% or more, about 600% or more, about 650% or more, about 700% or more, about 800% or more, about 900% or more, about 1000% or more as acoustically sealed as a corresponding acoustic seal resulting from placement of the same earphone ear interface in/against an outer ear system (in the outer ear canal, in the auricle or against the auricle as would be the case for the three earphones detailed above with respect to FIGS. 2A, 2B and 2C) of a statistically average size outer ear system of a human being of a given population and an outer ear system larger and/or smaller than that that falls within about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9 and 3.0 and/or more standard deviations from the statistically sized average.

In some embodiments, the volume of space (i.e., the volume of air) between earphone ear interface and external component established by the acoustic coupler is about 50%, about 55%, about 60%, about 65%, about 70%, about 75%, about 80%, about 85%, about 90%, about 95%, about 100%, about 105%, about 110%, about 115%, about 120%, about 125%, about 130%, about 135%, about 140%, about 145%, about 150%, about 155%, about 160% or about 165% as a corresponding volume resulting from placement of the same earphone ear interface in/against an outer ear system (in the outer ear canal, in the auricle or against the auricle as would be the case for the three earphones detailed above with respect to FIGS. 2A, 2B and 2C) of a statistically average size outer ear system of a human being of a given population and an outer ear system larger and/or smaller than that that falls within about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9 and 3.0 and/or more standard deviations from the statistically sized average. In an exemplary embodiment, the volume of space corresponds to the volume of space that exists when the aforementioned acoustic seals are formed.

With respect to a given population, such a population may include, in some embodiments, the population of the entire world. In other embodiments, it may be directed to an ethnic populace such as for example Caucasians, Mongoloids and/or Negroids. In yet other embodiments, the aforementioned population may be limited to a geographic region such as North America, South America, Asia, Europe, Africa and/or Australia. In yet other embodiments, the population may be limited to citizens and/or residents of specific countries, such as the United States, Australia, Canada, the United Kingdom, France, Germany, Spain, Sweden, Italy, China, India, Japan, Mexico, etc. The population may be limited to adults, may be limited to children, may be limited to adolescents or may be limited to the combination thereof (e.g. adolescents and adults, children and adolescents). In some embodiments, the population may be limited to humans at and/or about a certain age, such as, for example 12, 13, 14, 15, 16, 17, 18, 19, 20, 21, 22, 23, 24, 25, 26, 27, 28, 20, 25, 30, 40, 50, 60, 65, 70, 75, 80, 85 and/or 90 years old etc.

Some embodiments detailed herein and/or variations thereof permit a recipient to listen to sound (e.g., music) outputted by a earphone system (or other device), where the hearing percept approaches a general overall acoustic quality and/or, or the acoustic quality as measured by any one or more than one of the above-identified acoustic quality measurements of at least about 20%, at least about 30%, at least about 40%, at least about 45%, at least about 50%, at least about 55%, at least about 60%, at least about 65%, at least about 70%, at least about 75%, at least about 80%, at least about 85%, at least about 90%, at least about 95%, and/or about 100% of that corresponding to a sound inputted into the BTE device (e.g., BTE device 300), or other external device as detailed herein and/or variations thereof, via the audio signal jack 310 in the same anbient environment. Accordingly, some embodiments detailed herein and/or variations thereof permit the just-described performance to be achieved without the recipient having to have to open the cover 320 of BTE device 300, which may require a tool or the like, and may require the recipient to take off the BTE device entirely and/or remove the battery 352) and plug in a cable from the audio device. As noted above, in some embodiments, some and/or all of the qualities detailed herein may be enhanced/changed/adjusted, etc., upward or downward by these percentages (e.g., volume increased, signal to noise ratio decreased, etc.)

Also, in at least some exemplary embodiment as detailed herein and/or variations thereof, some and/or all of the above-mentioned performance features may be achieved without the use of wireless communication. Some such exemplary embodiments permit the above-mentioned performance features may be achieved with zero percent chance of radio frequency interference between final output from the source to initial receipt by the microphone 302 of the BTE device that may compromise signal quality (e.g., from ambient electromagnetic noise from sources such as power lines and nearby electronics devices, that can limit the quality of the signal), may result in increased power consumption, and/or may drive increased cost of the telecoil or other interface devices.

It is noted that in some embodiments, the above-identified performance features may be achieved utilizing acoustic couplers detailed herein and/or variations thereof because the acoustic coupler permits the sound from the earphone ear interface to be directed into the microphone of the external component and because the acoustic coupler may reduce ambient noise that may be received by the microphone as compared to that which may be received in the absence of the acoustic coupler. The above-identified performance features reflect embodiments where some acoustic coupler configurations permit more ambient noise to be received by the speaker than other acoustic coupler configurations, which may be based on the amount that a particular type of user finds desirable.

It is further noted that some embodiments include acoustic couplers where the internal cavity is vented to ambient atmosphere. This could provide an acoustic path to the ambient atmosphere. In some embodiments, this may enhance the performance qualities of the acoustic coupler relative to an acoustic coupler of the same configuration without vents. In some embodiments, vents may be achieved via gaps between the earphone ear interface and the acoustic coupler. In other embodiments, through holes may extend from an outer surface of the acoustic coupler laterally to the cavity. Any device, system and/or method that will permit venting of the cavity in the acoustic coupler may be used in some embodiments.

In an exemplary embodiment, the acoustic coupler is a squat body, and in an exemplary embodiment, the coupling body is a monolithic component.

While various embodiments of the present technology have been described above, it should be understood that they have been presented by way of example only, and not limitation. It will be apparent to persons skilled in the relevant art that various changes in form and detail can be made therein without departing from the spirit and scope of the technology. For instance, features described as part of one implementation can be used on another implementation to yield a still further implementation. Thus, the breadth and scope of the present technology should not be limited by any of the above-described exemplary embodiments, but should be defined only in accordance with the following claims and their equivalents. All patents and publications discussed herein are hereby incorporated in their entirety by reference thereto.

What is claimed is:

1. An acoustic coupler, comprising:

a coupling body configured to establish an acoustic path between an earphone ear interface and a microphone of an external component of a hearing prosthesis while the external component is worn by a recipient, wherein the acoustic path is a passive acoustic path; and the acoustic coupler is configured to retain the earphone ear interface to the coupling body under an acceleration of the acoustic coupler of two Gs in a first direction along a longitudinal axis of the acoustic path and in an opposite direction to the first direction.

2. An acoustic coupler for a hearing device, the hearing device comprising a microphone, the acoustic coupler comprising:

an earphone receptacle formed to releasably engage an earphone therein, wherein a securing feature configured to detachably engage the coupler to the hearing device in proximity to the microphone, wherein the acoustic coupler is configured to establish an acoustic path such that an acoustic quality of sound waves generated by a speaker of the earphone received by the microphone is enhanced relative to that which would be exhibited, for a same sound wave output from the speaker if the earphone was positioned at a same distance and at a same orientation relative to the microphone without the acoustic coupler establishing the acoustic path under same ambient environmental conditions, and the acoustic coupler is configured to retain the earphone to the hearing device under an acceleration of the acoustic coupler of two Gs in a first direction along a longitudinal axis of a cavity of the acoustic coupler and in an opposite direction to the first direction.

3. The acoustic coupler of claim 2, wherein:

the enhancement is at least about a 50% increase in volume.

4. The acoustic coupler of claim 2, wherein:

the enhancement is at least about a 30% decrease in attenuation.

5. The acoustic coupler of claim 2, wherein:

the enhancement is at least about a 50% decrease in attenuation.

6. An acoustic coupler, comprising:

a coupling body having a cavity extending from a first opening in the coupling body to a second opening in the coupling body, wherein:

the acoustic coupler is configured to:

interface with an earphone ear interface at least one of proximate the cavity or in the cavity and interface with an external component of a hearing prosthesis at least one of proximate the cavity or in the cavity, while the external component is worn by a recipient, such that an acoustic path is established by the cavity between the earphone ear interface and a microphone of the external component, wherein the acoustic coupler is configured to interface with a microphone area of the external component at least one of proximate the cavity or in the cavity; and the acoustic coupler is configured to retain the earphone ear interface to the coupling body under an acceleration of the acoustic coupler of two Gs in a first direction along a longitudinal axis of the cavity and in an opposite direction to the first direction.

7. The acoustic coupler of claim 6, wherein:

the cavity is formed by a generally cylindrical body having a cavity therein.

8. The acoustic coupler of claim 6, wherein:

the coupling body includes coupling walls establishing the cavity sized and dimensioned to receive the earphone ear interface therein.

9. The acoustic coupler of claim 6, wherein:

the coupling body is sized and dimensioned to receive the earphone ear interface in the cavity.

10. The acoustic coupler of claim 6, wherein:

the coupling body is sized and dimensioned to receive the earphone ear interface in the cavity and retain the earphone ear interface therein via friction between the coupling body and the earphone ear interface.

11. The acoustic coupler of claim 6, wherein:

at least a portion of the coupling body is formed of at least one of an elastically or plastically deformable material configured to deform about the earphone ear interface when the earphone ear interface is positioned proximate the first opening of the cavity.

12. The acoustic coupler of claim 6, wherein:

at least a portion of the coupling body forming the cavity is formed of at least one of an elastically or plastically deformable material configured to deform about the earphone ear interface when the earphone ear interface is positioned in the cavity.

13. The acoustic coupler of claim 6, wherein the acoustic coupler is configured to:

removably retain the external component thereto such that the microphone of the external component is at least proximate the cavity or in the cavity, thereby establishing the acoustic path.

14. An acoustic coupler of claim 6, further comprising:

a skin configured to removably attach to the external component, wherein the acoustic coupler of claim 1 is attached to the skin such that the acoustic coupler is removably attached to the external component.

15. The acoustic coupler of claim 6, further comprising:

an earhook configured to removably attach to the external component, wherein the external component is a BTE device, and the acoustic coupler is attached to the earhook such that the acoustic coupler is removably attached to the external component.

16. The acoustic coupler of claim 2, wherein:
the enhancement is at least about a 30% increase in volume.
17. The acoustic coupler of claim 2, wherein:
the earphone receptacle forms an interior cavity from an engaged earphone to a microphone of a detachably engaged hearing device.
18. The acoustic coupler of claim 2, wherein:
the securing feature comprises a releasable adhesive.
19. The acoustic coupler of claim 2, wherein:
the securing feature comprises elastic polymer.
20. The acoustic coupler of claim 2, wherein:
the securing feature detachably engages the coupler to the hearing device around the hearing device.
21. The acoustic coupler of claim 2, wherein:
the securing feature comprises an elastic ring.
22. The acoustic coupler of claim 2, wherein:
the securing feature comprises a strap-and-clasp assembly.
23. The acoustic coupler of claim 2, wherein:
the securing feature comprises a hook-and-loop closure.
24. The acoustic coupler of claim 2, wherein:
the securing feature detachably engages the coupler to the hearing device by mating to a corresponding feature on the hearing device.
25. The acoustic coupler of claim 2, wherein:
the securing feature comprises at least one post; and
each post is configured to engage with a corresponding hole of the hearing device.
26. The acoustic coupler of claim 2, wherein:
the securing feature engages a protective cover of the hearing device.
27. A method of coupling an earphone to a hearing device, the method comprising:
engaging the earphone in an earphone receptacle of an acoustic coupler, the acoustic coupler comprising:
the earphone receptacle formed to releasably engage the earphone therein; and
a securing feature formed to detachably engage the coupler to the hearing device in proximity to the microphone; and
engaging the securing feature of the acoustic coupler with the hearing device, wherein
the acoustic coupler is configured to interface with a microphone area about the microphone; and
the acoustic coupler is configured to retain the earphone ear interface to the coupling body under an acceleration of the acoustic coupler of two Gs in a first direction along a longitudinal axis of the acoustic coupler and in an opposite direction to the first direction.
28. The method of claim 27, wherein:
the earphone receptacle forms an interior cavity from an engaged earphone to a microphone of a detachably engaged hearing device.
29. The method of claim 28, wherein:
the securing feature engages a protective cover of the hearing device.
30. The acoustic coupler of claim 1, wherein:
the coupling body is configured to establish an acoustic path between the earphone ear interface and a plurality of microphones of the hearing prosthesis while the external component is worn by the recipient.
31. The acoustic coupler of claim 1, wherein:
the coupling body is configured to establish an acoustic path between the earphone ear interface and the microphone of the hearing prosthesis while the external component is worn by the patient without establishing an acoustic path between the earphone ear interface and at least one other microphone of the hearing prosthesis while the external component is worn by the recipient.
32. The acoustic coupler of claim 6, wherein:
the cavity extends along a first axis and a second axis that is about orthogonal to the first axis.
33. The acoustic coupler of claim 6, wherein:
the first opening in the coupling body is at least about orthogonal to the second opening in the coupling body.
34. The acoustic coupler of claim 6, wherein:
acoustic coupler is configured to removably retain the earphone ear interface thereto in an orientation such that a face of the earphone ear interface that faces into an ear canal when worn on a human is at least about orthogonal to a base of the acoustic coupler that interfaces with the external component.
35. The acoustic coupler of claim 1, wherein:
the coupling body is configured to hold and maintain the earphone ear interface at an orientation relative to the microphone.
36. The acoustic coupler of claim 1, wherein:
a full distance of the acoustic path extends within an immediate vicinity of the microphone.
37. The acoustic coupler of claim 6, wherein:
the acoustic coupler is configured such that the cavity constantly extends in a substantially fixed direction.
38. The acoustic coupler of claim 1, wherein:
the coupling body is a means for establishing an acoustic path that is in its entirety proximate to the microphone while the external component is worn by a recipient.
39. The acoustic coupler of claim 6, wherein:
the coupling body is a means for fixedly carrying the earphone ear interface on the external component of the hearing prosthesis while the external component is worn by a recipient.
40. The acoustic coupler of claim 6, wherein:
the coupling body is a means for holding the earphone ear interface proximate to the microphone.
41. The acoustic coupler of claim 2, wherein:
the acoustic coupler is configured to maintain the earphone in close proximity to the microphone.
42. The acoustic coupler of claim 1, further comprising:
the external component;
an earphone including the earphone ear interface, the earphone ear interface being located such that an acoustic path is established between the earphone ear interface and the microphone and such that the earphone is in direct contact with the coupling body; and
a separate device from the external component, wherein the separate device is a portable electronic device configured to play music, and wherein the separate device is in signal communication with the earphone.
43. The method of claim 27, the method further comprising:
placing the earphone into signal communication with a separate device from the hearing device, wherein the separate device is a portable electronic device configured to play music; and
playing music with the portable electronic device such that the earphone outputs music.
44. The acoustic coupler of claim 1, further comprising:
a plurality of earphones, one of which includes the earphone ear interface; and
a separate device from the external component, wherein the separate device is a portable electronic device configured to play music, and wherein the separate device is in signal communication with the earphone, wherein the earphone ear interface is located such that an acoustic path is established between the earphone ear interface and the microphone and such that the earphone having the earphone ear interface is in direct contact with the coupling body.

45. The method of claim 27, the method further comprising:

placing the earphone into signal communication with a separate device from the hearing device, wherein the separate device is a portable electronic device configured to play music;

playing music with the portable electronic device such that the earphone outputs music; and evoking a hearing percept in a recipient via the hearing device, the hearing percept being based on the music outputted by the earphone.

46. The acoustic coupler of claim 6, wherein:

the coupling body has walls establishing the cavity having a thin wall thickness relative to an internal diameter of the cavity at a location proximate the internal diameter.

47. The acoustic coupler of claim 6, wherein:

the coupling body has walls establishing the cavity having a thick wall thickness relative to an internal diameter of the cavity at a location proximate the internal diameter.

48. The method of claim 27, the method further comprising:

placing the earphone into signal communication with a separate device from the hearing device, wherein the separate device is a portable electronic device configured to play music; and playing music with the portable hearing device such that the earphone outputs music while at least one of walking or running.

49. The method of claim 27, the method further comprising:

placing the earphone into signal communication with a separate device from the hearing device, wherein the separate device is a portable electronic device configured to play music;

playing music with the portable electronic device such that the earphone outputs music; and evoking a hearing percept in a recipient via the hearing device, the hearing percept being based on the music outputted by the earphone, wherein the hearing device includes a behind-the-ear (BTE) device, and wherein the hearing percept is evoked while the recipient is wearing the BTE device.

* * * * *